US012492630B2

(12) United States Patent
Ooi et al.

(10) Patent No.: US 12,492,630 B2
(45) Date of Patent: Dec. 9, 2025

(54) SYSTEM AND METHOD FOR APPLIED ARTIFICIAL INTELLIGENCE IN AZIMUTHAL ELECTROMAGNETIC IMAGING

(71) Applicants: King Abdullah University of Science and Technology, Thuwal-Jeddah (SA); SAUDI ARABIAN OIL COMPANY, Dhahran (SA)

(72) Inventors: Guang An Ooi, Thuwal (SA); Mohamed Larbi Zeghlache, Al Khobar (SA); Shehab Ahmed, Thuwal (SA); Tarek Mostafa, Thuwal (SA); Moutazbellah A. Khater, Thuwal (SA); Hakan Bagci, Thuwal (SA); Mehmet Burak Ozakin, Thuwal (SA)

(73) Assignees: SAUDI ARABIAN OIL COMPANY, Dhahran (SA); KING ABDULLAH UNIVERSITY OF SCIENCE AND TECHNOLOGY, Thuwal-Jeddah (SA)

( * ) Notice: Subject to any disclaimer, the term of this patent is extended or adjusted under 35 U.S.C. 154(b) by 215 days.

(21) Appl. No.: 18/320,070

(22) Filed: May 18, 2023

(65) Prior Publication Data

US 2024/0384651 A1 Nov. 21, 2024

(51) Int. Cl.
*E21B 47/13* (2012.01)
*E21B 47/085* (2012.01)

(52) U.S. Cl.
CPC ..... *E21B 47/13* (2020.05); *E21B 47/085* (2020.05); *E21B 2200/22* (2020.05)

(58) Field of Classification Search
CPC .... E21B 47/13; E21B 47/085; E21B 2200/22; E21B 47/006
See application file for complete search history.

(56) References Cited

U.S. PATENT DOCUMENTS 7,385,400 B2 6/2008 Moore
10,234,592 B2 3/2019 Liu et al.
(Continued)

FOREIGN PATENT DOCUMENTS

CN 110610061 A 12/2019
CN 112814649 A 5/2021
(Continued)

OTHER PUBLICATIONS

International Search Report issued for corresponding international patent application No. PCT/US2024/029113, mailed Oct. 28, 2024 (8 pages).

(Continued)

*Primary Examiner* — Lee E Rodak
*Assistant Examiner* — Zannatul Ferdous
(74) *Attorney, Agent, or Firm* — Osha Bergman Watanabe & Burton LLP

(57) ABSTRACT

An electromagnetic (EM) inspection tool for inspecting a pipe that includes a longitudinally extending body having a first end, a second end, and a central longitudinal axis. The EM inspection tool further includes a transmitter disposed proximate the first end and configured to generate an alternating EM field at a first frequency. The EM inspection tool further includes a first far-field receiver plate disposed proximate the second end, wherein the first far-field receiver plate includes a first far-field receiver disposed at a first radial location and a second far-field receiver disposed at a second radial location. The EM inspection tool further includes a first near-field receiver plate disposed circumferentially around the transmitter, wherein the first near-field receiver plate includes a first near-field receiver disposed at the first radial location and a second near-field receiver disposed at the second radial location.

13 Claims, 17 Drawing Sheets

(56) References Cited

U.S. PATENT DOCUMENTS

| | | | | |
|---|---|---|---|---|
| 10,901,111 | B2 | 1/2021 | Donderici et al. | |
| 10,968,735 | B2 * | 4/2021 | Fan | E21B 47/125 |
| 2014/0145857 | A1 * | 5/2014 | Comparetto | E21B 47/12 340/854.6 |
| 2019/0162870 | A1 | 5/2019 | San Martin et al. | |
| 2020/0057092 | A1 * | 2/2020 | Ell | G01P 5/245 |
| 2020/0300084 | A1 * | 9/2020 | Bittar | E21B 47/04 |
| 2020/0371266 | A1 * | 11/2020 | Donderici | G01V 3/28 |
| 2021/0116599 | A1 * | 4/2021 | Kroczka | G01V 1/40 |
| 2022/0011463 | A1 | 1/2022 | Teague | |
| 2022/0058440 | A1 | 2/2022 | Feng et al. | |
| 2023/0177224 | A1 * | 6/2023 | Weiss | G06F 30/12 703/1 |

FOREIGN PATENT DOCUMENTS

| | | | |
|---|---|---|---|
| CN | 114065909 | A | 2/2022 |
| EP | 4 028 639 | A1 | 7/2022 |
| WO | 2022125082 | A1 | 6/2022 |

OTHER PUBLICATIONS

Written Opinion issued for corresponding international patent application No. PCT/US2024/029113, mailed Oct. 28, 2024 (13 pages).

G.A. Ooi, et al., "Multi-Frequency Data Acquisition Model and Hybrid Neural Network for Precise Electromagnetic Wellbore Casing Inspection," SPE-211807-MS; Society of Petroleum Engineers, 2022 (13 pages).

Ooi, Guang An et al., "EM-Based 2D Corrosion Azimuthal Imaging using Physics Informed Machine Learning PIML"; Proceedings of the SPE Offshore Europe Conference & Exhibition; Paper No. SPE-205404-MS; pp. 1-15; Sep. 7, 2021 (15 pages).

Zeghlache, Mohamed Larbi et al., "Comprehensive Casing Corrosion Inspection Using Multi-Frequency Array EM Technology"; Proceedings of the SPE International Oilfield Corrosion Conference and Exhibition; Paper No. SPE-205050-MS; pp. 1-15; Jun. 16, 2021 (15 pages).

Jawed, Rehan et al., "Through Tubing Casing Break Detection: An EM Thickness Tool Application"; Proceedings of the SPE Canada Heavy Oil Conference; Paper No. SPE-199952-MS; pp. 1-14; Sep. 24, 2020 (14 pages).

Wang, Bin et al., "Prediction model of natural gas pipeline crack evolution based on optimized DCNN-LSTM"; Mechanical Systems and Signal Processing; vol. 181, Article 109557; pp. 1-21; Dec. 1, 2022 (21 pages).

Zhu, Chunxiang et al., "State of Health Estimation of Lithium-Ion Battery Using Time Convolution Memory Neural Network"; Mobile Information Systems; vol. 2021, Article ID 4826409; pp. 1-16; Dec. 14, 2021 (16 pages).

Brill, Thilo Michael et al., "Quantitative Corrosion Assessment with an EM Casing Inspection Tool"; Proceedings of the SPE/DGS Saudi Arabia Section Technical Symposium and Exhibition; Paper No. SPE-149069-MS; pp. 1-16; May 15, 2011 (16 pages).

Brill, T.M. et al., "Electromagnetic Casing Inspection Tool for Corrosion Evaluation"; Proceedings of the International Petroleum Technology Conference; Paper No. IPTC-14865-MS; pp. 1-14; Nov. 15, 2011 (14 pages).

Khater, Moutazbellah et al., "Remote Field Eddy Current System Using Three Axis Fluxgate Magnetometer for Corrosion Inspection"; Proceedings of the SPE Annual Technical Conference and Exhibition; Paper No. SPE-210454-MS; pp. 1-15; Sep. 26, 2022 (15 pages).

Mostafa, Tarek M. et al., "A Comprehensive and Low-Cost Wellbore Tubing and Pipeline Inspection Tool Using Electromagnetic Coupling and Machine Learning"; Proceedings of the SPE Annual Technical Conference and Exhibition; Paper No. SPE-210318-MS; pp. 1-17; Sep. 26, 2022 (17 pages).

* cited by examiner

SYSTEM AND METHOD FOR APPLIED ARTIFICIAL INTELLIGENCE IN AZIMUTHAL ELECTROMAGNETIC IMAGING

BACKGROUND

In the oil and gas industry, corrosion continually affects the production tubing, casings, and pipelines associated with wells. The corrosion stems from chemical, electrochemical, and mechanical processes and requires costly repair and maintenance operations to prevent loss of produced hydrocarbons. If left unchecked, corrosion may result in the abandonment of a well. Therefore, to properly maintain a well, reduce repair and maintenance costs, and prevent unscheduled downtime, the integrity of the well must be assessed.

To assess the integrity of a well and inform well development and production plans, various corrosion inspection tools and methods have been developed. Conventionally used corrosion inspection tools may include mechanical calipers, ultrasonic tools, and electromagnetic (EM) tools. While each of these tools may provide a useful indication of corrosion, they are each limited in their inspection capabilities. For example, mechanical calipers can only measure the internal diameter of a pipe, or the innermost pipe when more than one concentric pipe is used. To date, EM inspection tools can only measure the circumferential average thickness of one or more pipes.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

Embodiments disclosed herein generally relate to an electromagnetic (EM) inspection tool for inspecting a pipe that includes a longitudinally extending body having a first end, a second end, and a central longitudinal axis. The EM inspection tool further includes a transmitter disposed proximate the first end and configured to generate an alternating EM field at a first frequency. The EM inspection tool further includes a first far-field receiver plate disposed proximate the second end, wherein the first far-field receiver plate includes a first far-field receiver disposed at a first radial location and a second far-field receiver disposed at a second radial location. The EM inspection tool further includes a first near-field receiver plate disposed circumferentially around the transmitter, wherein the first near-field receiver plate includes a first near-field receiver disposed at the first radial location and a second near-field receiver disposed at the second radial location.

Embodiments disclosed herein generally relate to a method for inspecting a pipe that includes deploying an electromagnetic (EM) inspection tool to a first section in the pipe where the first section includes a first layer. The EM inspection tool includes a longitudinally extending body having a first end, a second end, and a central longitudinal axis. The EM inspection tool further includes a transmitter disposed proximate the first end and configured to generate an alternating EM field at a first frequency. The EM inspection tool further include a first far-field receiver plate disposed proximate the second end, where the first far-field receiver plate includes a first far-field receiver disposed at a first radial location and a second far-field receiver disposed at a second radial location. The EM inspection tool further includes a first near-field receiver plate disposed circumferentially around the transmitter, where the first near-field receiver plate includes a first near-field receiver disposed at the first radial location and a second near-field receiver disposed at the second radial location. The method further includes obtaining a first plurality of receiver measurements from the EM inspection tool at the first section and predicting, using a composite machine-learned model, a first cross-sectional thickness profile of the pipe using the first plurality of receiver measurements.

Embodiments disclosed herein generally relate to a computer-implemented method of training a composite machine-learned model. The training method includes constructing a first simulation domain that includes a first simulated 3-dimensional pipe containing a first set of defects and that has a first known cross-sectional thickness profile and an electromagnetic (EM) inspection tool within the first simulated 3-dimensional pipe, where the EM inspection tool includes a transmitter and a plurality of receivers. The training method further includes constructing a second simulation domain that includes a second simulated 3-dimensional pipe containing a second set of defects and that has a second known cross-sectional thickness profile and the electromagnetic (EM) inspection tool within the second simulated 3-dimensional pipe. The training method further includes generating, with a forward model, a first plurality of receiver measurements using the first simulation domain and generating, with the forward model, a second plurality of receiver measurements using the second simulation domain. The training method further includes collecting a first training set that includes the first plurality of receiver measurements and associated first known cross-sectional profile and the second plurality of receiver measurements and associated second known cross-sectional thickness profile. The training method further includes adding zero-mean Gaussian noise with a first variance to the first plurality of receiver measurements and to the second plurality of receiver measurements in the first training set and training the composite machine-learned model using the first training set.

Other aspects and advantages of the claimed subject matter will be apparent from the following description and the appended claims.

DETAILED DESCRIPTION

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as using the terms "before," "after," "single," and other such terminology. Rather, the use of ordinal numbers is to distinguish between the elements. By way of an example, a first element is distinct from a second element, and the first element may encompass more than one element and succeed (or precede) the second element in an ordering of elements.

It is to be understood that the singular forms "a," "an," and "the" include plural referents unless the context clearly dictates otherwise. Thus, for example, reference to "acoustic signal" includes reference to one or more of such acoustic signals.

Terms such as "approximately," "substantially," etc., mean that the recited characteristic, parameter, or value need not be achieved exactly, but that deviations or variations, including for example, tolerances, measurement error, measurement accuracy limitations and other factors known to those of skill in the art, may occur in amounts that do not preclude the effect the characteristic was intended to provide.

It is to be understood that one or more of the steps shown in the flowchart may be omitted, repeated, and/or performed in a different order than the order shown. Accordingly, the scope disclosed herein should not be considered limited to the specific arrangement of steps shown in the flowchart.

Although multiple dependent claims are not introduced, it would be apparent to one of ordinary skill that the subject matter of the dependent claims of one or more embodiments may be combined with other dependent claims.

Figure 1:
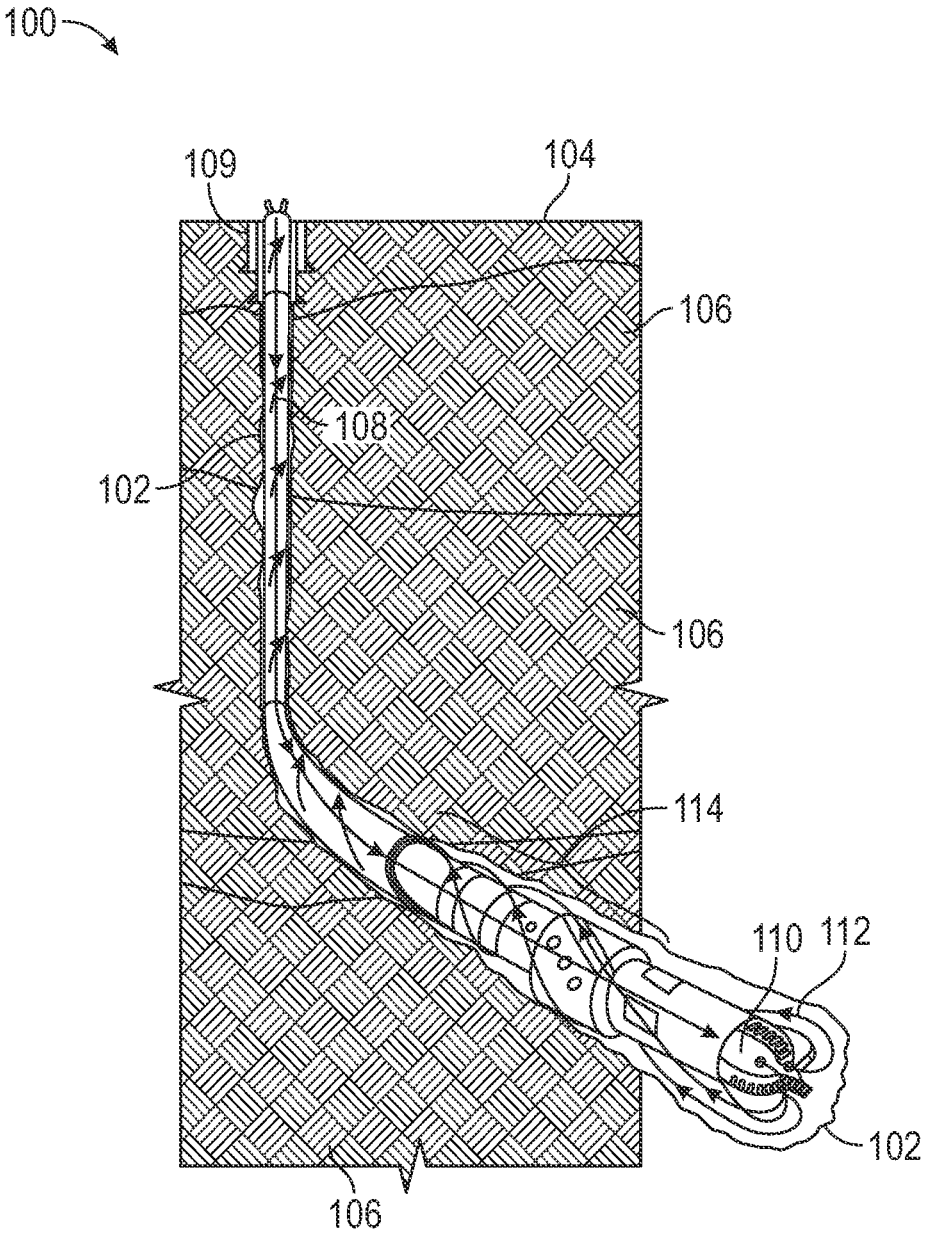
FIG. 1 depicts a drilling process, in accordance with one or more embodiments.

A general overview of the subsurface activities associated with a drilling process are provided in FIG. 1. For brevity, above surface equipment, or other offshore rig platform and equipment, used in a drilling operation are not depicted as well sites may be configured in many ways. However, exclusion of well site configurations should not be considered limiting as the tools and methods described herein are invariant to well site configurations. As seen, a drilling operation at a well site may include drilling a wellbore (102) into a subsurface region (106) including various formations to access one or more sources of hydrocarbons (i.e., reservoirs). To drill a new section of wellbore (102), typically, a drill bit (110) with drilling fluid nozzle is connected to the down-hole end of a drill string (108), which is a series of drill pipes connected to form a conduit, that is rotated from the surface (104) while pushing the drill bit (110) against the rock forming a wellbore (102) in the ground and through the subsurface (106). In some implementations, the drill bit (110) may be rotated by a combined effect of surface rotation and with a down-hole drilling motor (not shown).

While cutting rock with a drill bit (110), typically, a drilling fluid (112) is circulated (with a pump) through the drill string (108), out of the drilling fluid nozzle of the drill bit (110), and back to the surface (104) through the substantially annular space between the wellbore (102) and the drill string (108). Moreover, the drill string (108) may contain a bottom hole assembly (BHA) (114) disposed at the distal end, or down-hole portion, of the conduit. To guide the drill bit (110), monitor the drilling process, and collect data about the subsurface (106) formations, among other objectives, the BHA (114) of the drill string (108) may be outfitted with "logging-while-drilling" (LWD) tools, "measurement-while-drilling-tools" (MWD), and a telemetry module. An MWD or LWD tool is generally a sensor, or measuring device, which collects information in an associated log during the drilling process. The measurements and/or logs may be transmitted to the surface (104) using any suitable telemetry system known in the art. The BHA (114) and the drill string (108) may contain other drilling tools known in the art but not specifically stated. By means of example, common logs, or information collected by LWD tools, may include, but are not limited to, the density of the subsurface (106) formation, the effective porosity of the subsurface (106) formation, and temperature.

Depending on the depth of a hydrocarbon bearing formation and other geological complexes, a well can have several hole sizes before it reaches its target depth. A steel pipe, or casing (109), may be lowered in each hole and a cement slurry may be pumped from the bottom up through the substantially annular space between the casing (109) and the wellbore (102) to fix the casing (109), and seal the wellbore (102) from the surrounding subsurface (106) formations. Upon finishing drilling the wellbore (102), the well may undergo a completions process to facilitate accessibility to the well and access the desired hydrocarbons. In some implementations, the final wellbore (102) can be completed using either cased and cemented pipe, which is later perforated to access the hydrocarbon, or it may be completed using a multi-stage open-hole packers assembly. Further, production tubing may be used to transport hydrocarbons from one or more reservoirs in the subsurface (106) formations to the surface (104).

Throughout the lifetime of a well, corrosion continually affects the production tubing, casings, and pipelines associated with the well. The corrosion stems from chemical, electrochemical, and mechanical processes and requires costly repair and maintenance operations to prevent the loss of produced hydrocarbons. If left unchecked, corrosion may result in negative environmental impacts and/or the abandonment of a well. To properly maintain a well, reduce repair and maintenance costs, mitigate negative environmental impacts, and prevent unscheduled downtime, the integrity of the well must be assessed.

To assess the integrity of a well and inform well development and production plans, various corrosion inspection tools and methods have been developed. Conventionally used corrosion inspection tools may include mechanical calipers, ultrasonic tools, and electromagnetic (EM) tools. While each of these tools may provide a useful indication of corrosion, they are each limited in their inspection capabilities. For example, mechanical calipers can only measure the internal diameter of a pipe, or the innermost pipe when more than one concentric pipe is used.

EM inspection tools, as will be explained in greater detail later in the instant disclosure, measure the response of a transmitted electromagnetic field using one or more onboard receivers. Generally, an EM inspection tool is deployed at various depths in a wellbore (102) and the response is evaluated to produce a measurement of corrosion in the surrounding casing(s) and/or production tubing. Here, it is noted that the term depth refers to the distance along the wellbore (102) and does not necessarily correspond with the orthogonal distance from the surface (104) where the orthogonal distance is measured along an axis oriented perpendicular to the surface (104), also known as the true vertical depth. By way of example, a portion of a wellbore (102) may be oriented horizontally, or parallel to the surface (104), such that its orthogonal distance remains fixed over the horizontal portion, however, the depth measures the distance along the wellbore (102) and is not stagnant over any horizontal portion of the wellbore (102). Additionally, the depth is continuous and strictly monotonically increasing as directed from the surface (104) to the most down-hole portion of the wellbore (102) even if the orthogonal distance, or true vertical depth, decreases.

Figure 2:
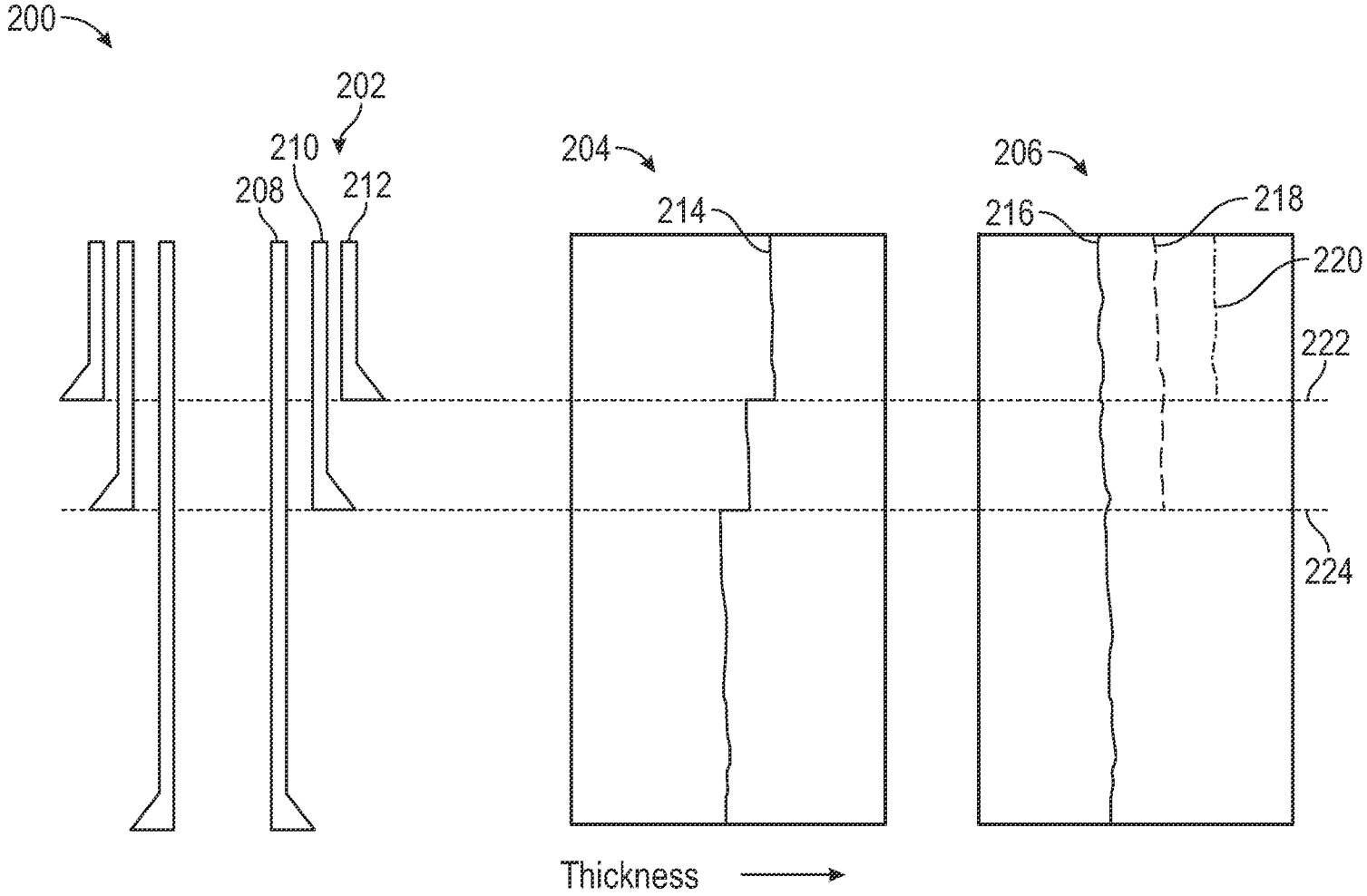
FIG. 2 depicts an evaluation of corrosion in concentric pipes, in accordance with one or more embodiments.

FIG. 2 depicts current EM corrosion evaluation (200) methods using an EM inspection tool. The current EM corrosion evaluation (200) methods can generally be categorized as either an aggregate method (204) or individualized method (206). The distinctions in these methods are highlighted by showing their results when an EM inspection tool is deployed in an example section of wellbore (202). The example section of wellbore (202) has three casings, Casing A (208), Casing B (210) and Casing C (212), where each of these casings extends a different depth into the wellbore. Using an aggregate method (204), an EM inspection tool can indicate the total thickness of all casings (214) surrounding the wellbore as a function of depth. Under an aggregate method (204), when a casing terminates, the measured total thickness of all casings (214) is reduced stepwise by the thickness of the terminated casing. In the example of FIG. 2, this stepwise reduction in the total thickness of all casings (212) can be seen at the termination of Casing C (222) and the termination of Casing B (224). When using an individualized method (206), an EM inspection tool can indicate the thickness of each casing (Casing A (208), Casing B (210), and Casing C (212)) distinctly as a function of depth. Using an individualized method (206), FIG. 2 depicts the total thickness of Casing A (216), the total thickness of Casing B (218), and the total thickness of Casing C (220). In the literature, there are multiple publications highlighting the benefits of using an EM inspection tool compatible for use with an individualized method (206) over an aggregate method (204). Principally, the capability to measure the total thickness of individual concentric casings (or pipes) promotes more proactive well integrity management systems by indicating which casing is affected by corrosion. Further, and especially for the case of external electrochemical corrosion at shallow depths, individualized methods (206) enable the profiling of metal loss along different barriers. Regardless of the method used (aggregate method (204) or individualized method (206)), a major advantage of using an EM inspection tool is that measurements of corrosion, indicated by the measured thickness of the casings at various depths, are not limited to a single casing. However, to date, EM inspection tools can only measure the average circumferential thickness, or total circumferential thickness, of the surrounding casings and/or tubing.

Figure 3A:
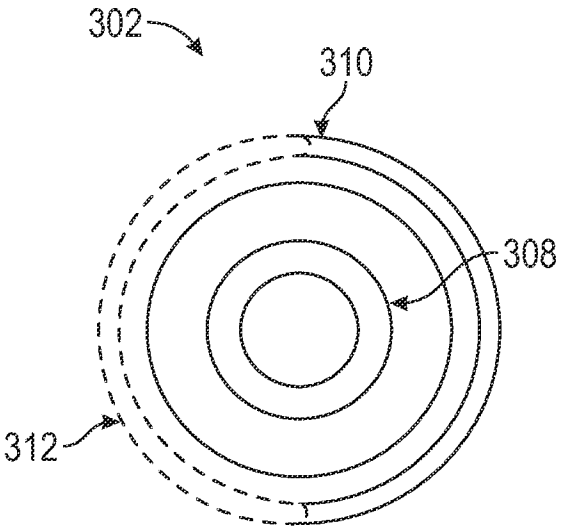
FIG. 3A depicts an example of corrosion in concentric pipes, in accordance with one or more embodiments.
Figure 3B:
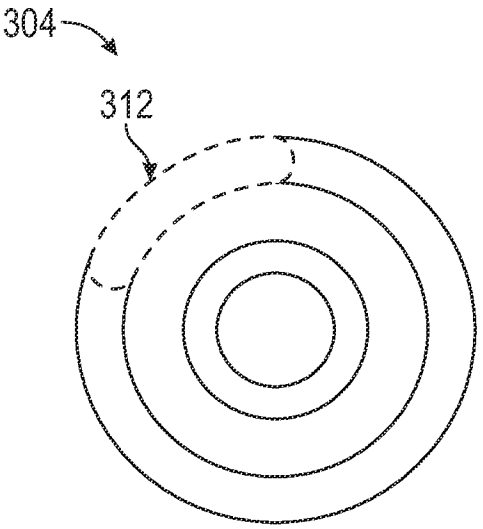
FIG. 3B depicts an example of corrosion in concentric pipes, in accordance with one or more embodiments.
Figure 3C:
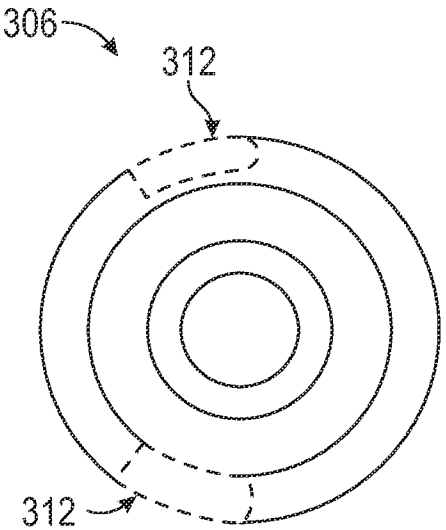
FIG. 3C depicts an example of corrosion in concentric pipes, in accordance with one or more embodiments.

A noted limitation of current EM corrosion evaluation (200) methods is that measurements of total or average circumferential thickness, whether applied to all surrounding casings (aggregate method (204)) or to individual surrounding casings (individualized method (206)), do not provide information about the radial location, extent, and pervasiveness of corrosion. Herein, a site of corrosion will be referred to as a defect. Under current EM corrosion evaluation (200) methods, defects of various radial locations and extents can yield the same measured total or average circumferential thickness. That is, mappings of defects to measured total or average circumferential thickness are not unique. FIGS. 3A, 3B, and 3C illustrate the cross-sections of two concentric pipes, specifically, a production tubing (308) encompassed by an outer casing (310) at various depths in a well. Further, FIGS. 3A, 3B, and 3C each depict an example of corrosion, where one or more defects (312), or an area of reduced or diminished thickness (i.e., corrosion), is present on the outer casing (312). Specifically, Corrosion Example A (302) of FIG. 3A displays a single defect (312) that covers half of the outer circumference of the outer casing (310) and does not extend through the entire thickness of the outer casing (310). Corrosion Example B (314) of FIG. 3B depicts a defect (312) that extends completely through nearly a quarter of the outer casing (310). Corrosion Example C (306) shows two defects (312) on the outer casing (310), one of which extends through the outer casing (310). The number, radial location, and extent of defects (312) are different between Corrosion Example A (302), Corrosion Example B (304), and Corrosion Example C (306). To effectively repair, maintain, and manage the well, a well integrity management strategy should be tailored according to the nature of the defects (312). For example, the best corrective measure for the defect (312) of Corrosion Example B (304) may not be the same for the defect of Corrosion Example A (302). However, despite the apparent differences in the number, location, and extent of the defects (312) between Corrosion Example A (302), Corrosion Example B (304), and Corrosion Example C (306), each of these examples have a 20% reduction in total thickness. As such, an EM inspection tool would provide identical measurements for Corrosion Example A (302), Corrosion Example B (304), and Corrosion Example C (306) resulting in an ambiguity as to which corrective measure or management strategy should be employed. The benefits of a corrosion inspection tool that can specify the number, location (both in terms of the radial location and which pipe in the case of concentric pipes), and extent of defects in the production tubing, casings, and pipelines associated with a well cannot be understated. Such a tool would, at least, provide the capability for tailored well integrity management strategies resulting in significant repair and maintenance cost savings, increased hydrocarbon production, and improved environmental protections.

In one aspect, embodiments disclosed herein generally relate to an EM inspection tool and associated machine-learned model and methods that can detect the number, location, and extent of defects (312) in a pipe or concentric pipes. The receivers of the EM inspection tool are arranged, and their measured responses organized, such that the recorded data contains spatial and phase information. The recorded data are processed by one or more composite machine-learned models to determine a 2-dimensional profile representing a cross-section in the surrounding pipe or surrounding concentric pipes. The 2-dimensional profile indicates the number, location, and extent of defects (312) in the surrounding pipe or pipes.

Figure 4:
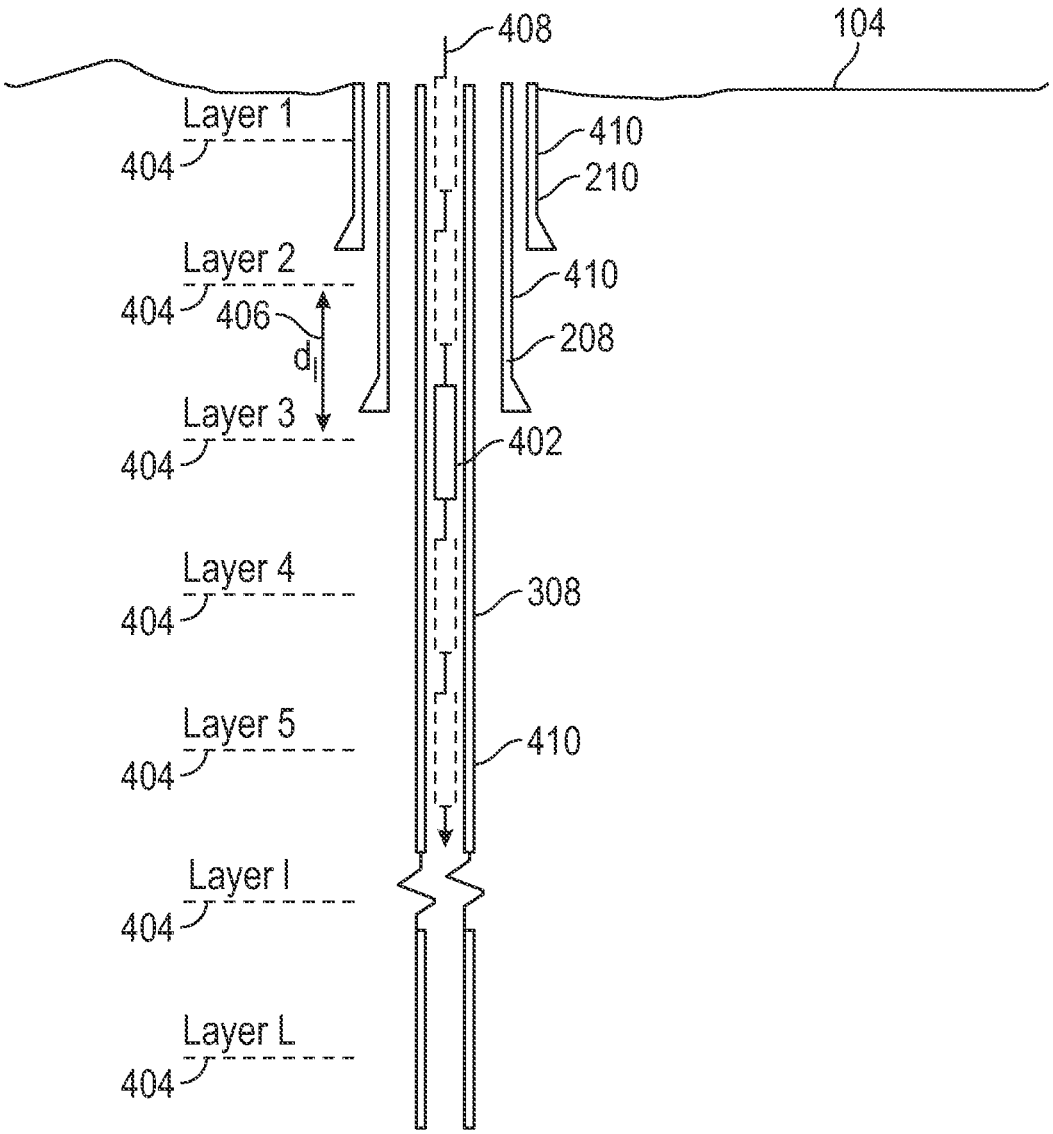
FIG. 4 depicts the progression of an electromagnetic (EM) inspection tool through concentric pipes, in accordance with one or more embodiments.

In accordance with one or more embodiments, FIG. 4 depicts the EM inspection tool (402) of the present disclosure descending in a well. Production tubing (308), Casing A (208), and Casing B (210) are used in the well. Previously, care has been taken to distinguish between production tubing (308) and various casings (109) that may be employed within a well. However, production tubing (308), casings (109), and pipelines associated with a well may all be more generally described as pipes. One with ordinary skill in the art will recognize that the EM inspection tool (402), methods, models, and processes of this disclosure may be readily applied to a single pipe or two or more substantially concentric pipes. For concision, the term pipe will be adopted herein to represent any number of pipes that may surround the EM inspection tool (402) at any given depth in the well. For example, in FIG. 4, depending on the depth of the EM inspection tool (402), the EM inspection tool (402) may be surrounded by only production tubing (308), production tubing (308) and Casing A (208), or production tubing (308), Casing A (208), and Casing B (210). In all cases, the surrounding environment detected by the EM inspection tool (402) will be referred to as pipe (410). That is, the term pipe, although conventionally singular, may refer to more than one pipe. The EM inspection tool (402), coupled with the one or more composite machine-learned models, produces a 2-dimensional profile representing the surroundings of the EM inspection tool (402). The 2-dimensional profile depicts the number of surrounding pipes as well as the location and extent of any defects in the surrounding pipes. Thus, pipe (410), in the context of the instant disclosure, can refer to more than one pipe without undue ambiguity as the exact number of pipes surrounding the EM inspection tool (402) at any given depth may be recovered by inspection of the produced 2-dimensional profile.

FIG. 4 further depicts the EM inspection tool (402) progression (408), in accordance with one or more embodiments. As seen, the EM inspection tool (402) enters the well from the surface (104) and is lowered into the well. Depths of the well are labelled as layers (404). In general, the well is spanned by L layers, where each layer is separated by an uniform layer separation distance (406), di.

Figure 5:
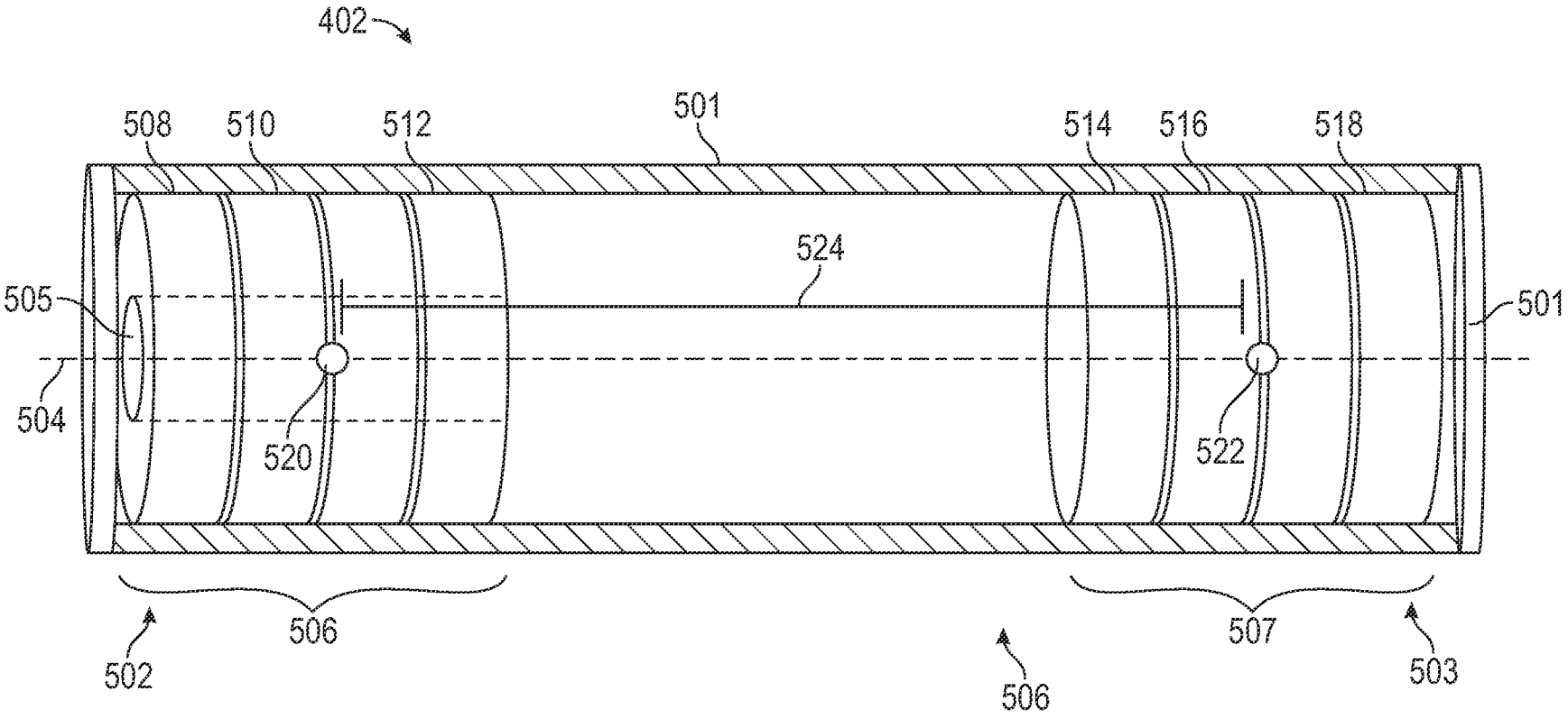
FIG. 5 depicts an EM inspection tool, in accordance with one or more embodiments.

The arrangement of select components of the EM inspection tool (402) is shown in FIG. 5, in accordance with one or more embodiments. The EM inspection tool (402) is composed of a longitudinally extending body (501) having a first end (502) and a second end (503). The body (501) defines a central longitudinal axis (504). A transmitter section (505) is disposed proximate the first end. The transmitter section (505) contains one or more transmitters, each configured to generate an alternating EM field according to a specified frequency. The EM inspection tool (402) contains an inertial measurement unit (IMU) (not shown). The IMU measures and tracks rotation of the EM inspection tool (402) about its central longitudinal axis (504). As such, using the IMU, the orientation of the EM inspection tool (402), as a whole, is known at any given time. The EM inspection tool (402) further includes a near-field stack (506) composed of one or more near-field plates. The near-field stack (506), and by association the one or more near-field plates, are disposed circumferentially around the transmitter section (505) near the first end (502), and the transmitter section (505) can be said to extend longitudinally through the near-field stack (506). A far-field stack (507), composed of one or more far-field plates, is disposed within the body (501) proximate the second end (503). The body (501) may terminate near the distal ends of the near-field stack (506) and far-field stack (507) or may extend beyond the near-field stack (506) and the far-field stack (507). As stated, the near-field stack (506) is composed of one or more near-field plates. Specifically, the near-field stack (506) is composed of N near-field plates. In accordance with one or more embodiments, the near-field plates may be considered ordered and may be labelled accordingly. Without loss of generality, the near-field plates may be labelled as a first near-field plate (508), a second near-field plate (510), and so on and so forth, until a final $N^{th}$ near-field plate (512). Likewise, the far-field stack (507) is composed of N far-field plates. The far-field plates may be labelled as a first far-field plate (514), a second far-field plate (516), and so on, until terminating with an $N^{th}$ far-field plate (518). In FIG. 5, the center of the transmitter section (505) is indicated as the transmitter section center (520). The center of the far-field stack (507) is indicated as the far-field receiver stack center (522). The transmitter section center (520) and the far-field receiver stack center (522) are separated by a stack distance (524). In accordance with one or more embodiments, the stack distance is set to 1.5 to 3.5 times the inner diameter of the innermost pipe surrounding the EM inspection tool (402) when the EM inspection tool (402) is in use. In one or more embodiments, the transmitter section (505) contains N transmitters where there is a one-to-one correspondence between transmitters and near-field plates. Each transmitter generates an EM field at a unique frequency. In one or more embodiments, additional near-field and far-field stacks may be included in the EM inspection tool (402). In these embodiments, the transmitter section includes at least one transmitter for generating an EM field and there is a one-to-one correspondence between transmitter sections and near-field stacks. In other embodiments, a transmitter section with at least one transmitter is supplied for each near-field stack and each far-field stack. Finally, it is noted that any and all near-field stacks and far-field stacks, and/or their associated plates, may operate independently and do not necessarily require a fixed distance from a transmitter section.

As described, the EM inspection tool (402) contains N near-field plates and N far-field plates, where N is an integer greater than or equal to 1. Further, because there is an equal number of near-field and far-field plates, the near-field plates and the far-field plates have a one-to-one correspondence and may be considered in pairs. In general, the $n^{th}$ near-field plate is paired with the $n^{th}$ far-field plate, where n is a number between 1 and N. Each plate, whether a near-field plate or a far-field plate, contains two or more receivers. For each $n^{th}$ pairing of a near-field plate and a far-field plate, each plate in the pair contains $M_n$ receivers, where $M_n \geq 2$. In accordance with one or more embodiments, the number of receivers within each of the near-field plate and far-field plate pairs is equal across all pairs. In this case, $M_1$, $M_2, \ldots, M_n, \ldots, M_{N-1}, M_N = M$, such that it may be said that each plate, whether a near-field plate or a far-field plate, contains M receivers without ambiguity.

In accordance with one or more embodiments, the receivers are distributed radially near the circumference of their respective plate. In one or more embodiments, the receivers are distributed equiangularly within their respective plate. In general, for the $n^{th}$ pair of a near-field and a far-field plate, if the receivers within the $n^{th}$ pair of plates are distributed equiangularly, any two adjacent receivers within each of the plates are separated by a receiver separation angle, $\phi_n$. For the $n^{th}$ pair of plates with equiangularly distributed receivers, the receiver separation angle, $\phi_n$, in degrees, is calculated as $$\phi_n = \frac{360}{M_n}.$$

In the case where every plate in the EM inspection tool (402) contains the same number of receivers (i.e., $M_1, M_2, \ldots, M_n, \ldots, M_{N-1}, M_N = M \geq 2$), and the receivers are distributed equiangularly, a global receiver separation angle $\phi$ may be defined without ambiguity. In the most general case, whether the receivers within a given plate are distributed equiangularly or not, the location of each receiver may be specified individually according to a radial location. For example, a first receiver in the first near-field plate may be disposed at a first radial location and a second receiver in the first near-field plate may be disposed at a second radial location.

Receivers within a plate, whether a near-field plate or a far-field plate, may be considered a group. In accordance with one or more embodiments, the group of receivers in the $n^{th}$ near-field plate is disposed identically to the group of receivers in the associated $n^{th}$ far-field plate. Further, and in accordance with one or more embodiments, for each pair of far- and near-field plates, the groups of receivers are angularly offset by an offset angle, $\theta_n$, where the offset angle is determined relative to an angle datum. In accordance with one or more embodiments, the offset angle for the groups of receivers in the $n^{th}$ pair of plates is given as $$\theta_n = (n-1)\frac{360}{N}.$$

In one or more embodiments, the offset angle for the groups of receivers in the $n^{th}$ pair of plates is given as $$\theta_n = (n-1)\frac{360}{M*N}.$$

Figure 6A:
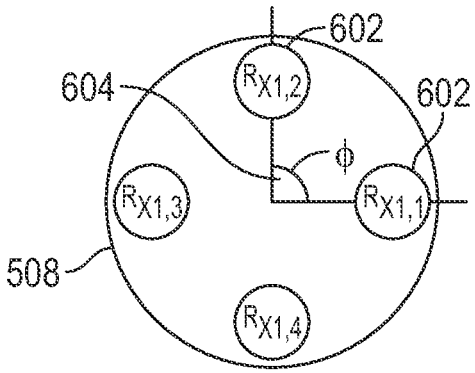
FIG. 6A depicts a first near-field receiver plate, in accordance with one or more embodiments.

FIGS. 6A-6D depict the placement of the receivers (602) in select near-field and far-field plates, in accordance with one or more embodiments. Note that, to minimize clutter in FIGS. 6A-6D, not all receivers (602) are annotated (i.e., a line does not extend from the label "602" to each receiver). However, for discussion, each receiver (602) is given a unique identifier. In general, a receiver (602) is represented with an R and associated subscript. The first portion of the comma-separated subscript identifies the plate in which the receiver (602) resides, where X indicates a near-field plate and F indicates a far-field plate and the accompanying number indicates the label, 1 through N, of the associated plate in its respective stack. For example, X1 indicates that the receiver (602) resides in the first near-field plate (508) and X2 indicates that the receiver (602) is in the second near-field plate (510). The second portion of the comma-separated subscript distinguishes a receiver (602) from all other receivers (602) in a given plate. For example, FIG. 6A illustrates four receivers (602) in the first near-field plate (508). Following the established pattern, these receivers (602) are labelled as $R_{X1,1}$, $R_{X1,2}$, $R_{X1,3}$, and $R_{X1,4}$ for the first, second, third, and fourth receivers (602) in the first near-field plate (508), respectively.

Figure 6C:
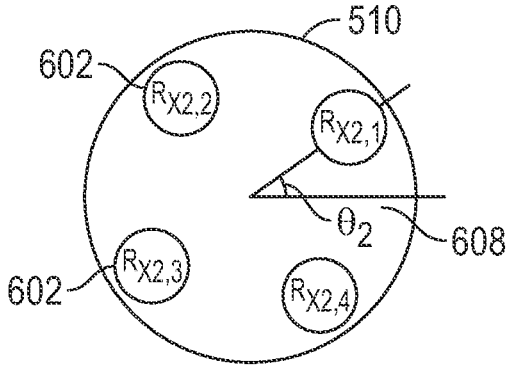
FIG. 6C depicts a second near-field receiver plate, in accordance with one or more embodiments.
Figure 6B:
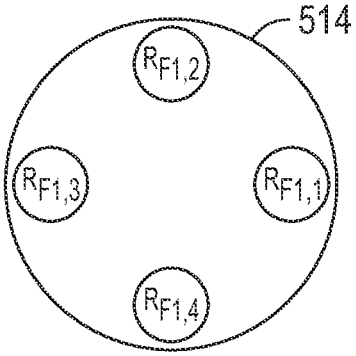
FIG. 6B depicts a first far-field receiver plate, in accordance with one or more embodiments.
Figure 6D:
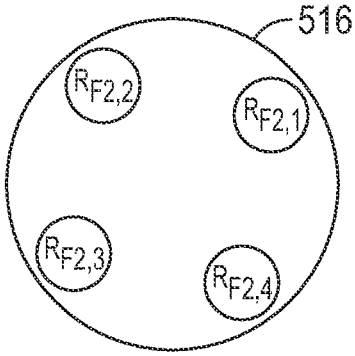
FIG. 6D depicts a second far-field receiver plate, in accordance with one or more embodiments.

As previously stated, the near-field plates and far-field plates may be considered in pairs. FIG. 6A depicts the first near-field plate (508) and FIG. 6B depicts the first far-field plate (514). The first near-field plate (508) and the first far-field plate (514) form a first pair. FIG. 6C depicts the second near-field plate (510) and FIG. 6D depicts the second far-field plate (516), where these form a second pair.

Further, FIGS. 6A-6D depict the first near-field plate (508), the second near-field plate (510), the first far-field plate (514), and the second far-field plate (516) as all containing four equiangularly distributed receivers (602) (i.e., M=4). While FIGS. 6A-6D only depict a first and second pair of near- and far-field plates, each with four equiangularly distributed receivers (602), one with ordinary skill in the art will recognize that this depiction is non-limiting. In practice, one or more pairs of near- and far-field plates may be used and each plate in a pair may contain two or more receivers.

Figure 6E:
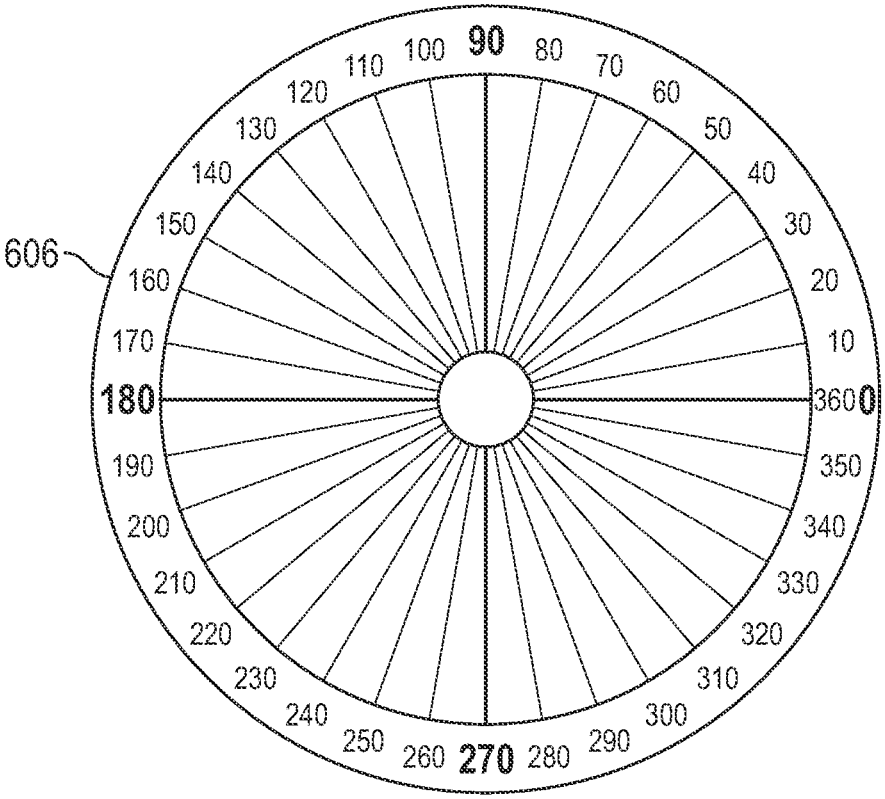
FIG. 6E depicts an angle datum, in accordance with one or more embodiments.

Because each of the plates in FIGS. 6A-6D contain four equiangularly distributed receivers (602), a global receiver separation angle (604), ¢, may be used, where, in the case of four receives (602) per plate, $\phi$=90 (degs). The receivers (602) in the first near-field plate (508) are distributed identically to the receivers (602) in the first far-field plate (514), as seen in FIGS. 6A and 6B. Likewise, the receivers (602) in the second near-field plate (510) are distributed identically as those in the second far-field plate (516), as demonstrated in FIGS. 6C and 6D. For FIGS. 6A-6D, the offset angle for the $n^{th}$ pair of plates, $\theta_n$ is determined according to $$\theta_n = (n-1)\frac{360}{N}$$

relative to the angle datum (606) provided in FIG. 6E. The origin of the angle datum (606) is arbitrary and, in practice, any angle datum (606) may be used so long as it is consistently applied to each pair of plates. In the example of FIGS. 6A-6D, the first pair and second pair of plates are shown, however, in total there are 10 pairs of plates (N=10). Thus, in the present example, $$\theta_1 = (1-1)\frac{360}{10} = 0(degs)$$

(not shown) and $$\theta_2 = (2-1)\frac{360}{10} = 36(degs)(608).$$

In FIGS. 6C and 6D, which show the second pair of plates, the respective groups of receivers are offset by 36 (degs) relative to the angle datum (606). Again, in the most general case, regardless of the distribution of receivers and the offset angles of their associated plates, the location of each receiver may be specified individually according to a radial location. For example, receiver $R_{X1,1}$ may be said to reside at a first radial location and receiver $R_{X1,2}$ at a second radial location. Receivers $R_{F1,1}$ and $R_{F1,2}$, residing in the first far-field plate (514) and having the same distribution as the receivers (602) in the first near-field plate (508), are likewise disposed at the first radial location and the second radial location, respectively. This practice of assigning receivers (602) to radial locations may continue for any number of receivers (602) and plate pairings. For example, receivers $R_{X1,3}$ and $R_{F1,3}$ may be defined as residing at a third radial location. And in the second pair (FIGS. 6C and 6D), receivers $R_{X2,1}$. $R_{F2,1}$ and $R_{X2,2}$ and $R_{F2,2}$ may be disposed at a fourth radial location and at a fifth radial location, respectively. For brevity, a radial location is not described for all the receivers (602) shown in FIGS. 6A-6E. However, one with ordinary skill in the art will appreciate that the instant disclosure has sufficiently described a pattern for the disposition of receivers (602) across one or more pairs of plates, such that the radial locations of the remaining receivers (602) in FIGS. 6A-6D need not be explicitly stated.

In basic terms, the EM inspection tool (402) operates by exciting an alternating current at a given frequency in a transmitter. The associated electromagnetic (EM) field induces eddy currents in the surrounding pipe (410). The EM field and the secondary eddy-current fields superimpose and generate a voltage in the receivers (602). Thus, the receivers measure the amplitude and phase of magnetic fields. The amplitude and phase measurement at a receiver is referenced herein as a receiver value, Z. The EM field is strongly affected by circumferential eddy currents inside the surrounding pipe (410). Thus, changes in the surrounding pipe (410), such as the number and spatial location of surrounding pipes and their thicknesses or diameters (i.e., defects (312)), cause and correlate with changes in the observed receiver value, Z, as recorded by each receiver (602). In accordance with one or more embodiments, and as will be described in greater detail later, the recorded receiver values are processed by one or more composite machine-learned models. Each of the one or more composite machine-learned models is composed of various deep neural networks and is capable of incorporating spatial and sequence information. Thus, each composite machine-learned model not only accepts the receiver values of the receivers (602) of the EM inspection tool (402), but is also informed by the relative location and ordering of each receiver (602). In other words, the receivers (602) of the EM inspection tool (402) are arranged, and their measured responses organized, such that the recorded data effectively, and implicitly, encodes a relationship between the receivers (602). The recorded data are processed by the one or more composite machine-learned models, each of which can make use of the encoded relationship between receivers (602) to determine a 2-dimensional profile representing a cross-section in the surrounding pipe (410). The 2-dimensional profile indicates the number, location, and extent of defects (312) in the surrounding pipe (410).

Each receiver value, Z, is complex valued and can be represented as either a real and imaginary number or an amplitude and phase. Each receiver (602) records a receiver value. Therefore, the receiver value of each receiver can be represented using the same notation defined for the receivers (602). For example, the receiver value of receiver $R_{X2,1}$ can be represented as $Z_{X2,1}$. Further, using the phase and amplitude representation of a receiver value, the receiver value can be written as $Z_{X2,1}=A_{X2,1}e^{\theta_{X2,1}}$. In general, the receiver value of a receiver is written as $Z_{Xn,m}=A_{Xn,m}e^{\theta_{Xn,m}}$ or $Z_{Fn,m}=A_{Fn,m}e^{\theta_{Fn,m}}$, where X and F indicate whether the receiver is on a near-field or a far-field plate, respectively, and n indicates the plate ($1 \le n \le N$), and m indicates the receiver on the plate ($1 \le m \le M_n$). In accordance with one or more embodiments, for each receiver pair in a given pairing of a near-field and a far-field plate (e.g., $R_{X2,3}$ and $R_{F2,3}$), the receiver values are combined into a complex number as follows:

$$S_{n,m} = A_{Xn,m} + i\theta_{Fn,m}. \tag{1}$$

In EQ. 1, $S_{n,m}$ indicates the combination receiver value for the $m^{th}$ receiver in the $n^{th}$ pair of near- and far-field plates. As seen in EQ. 1, for a pair of associated receivers (602), the amplitude of the receiver on the near-field plate is retained as the real component and the phase of the receiver on the far-field plate is retained as the imaginary component of the combination receiver value. In short, in EQ. 1 $A_{Xn,m}$ denotes the amplitude change of the $m^{th}$ coil on the $n^{th}$ near-field plate and $\theta_{Fn,m}$ denotes the phase change detected by the $m^{th}$ coil on the $n^{th}$ far-field plate. Because the combination receiver value combines information from both near- and far-field plates in a pair, the combination receiver value is not described using either an X or F. One with ordinary skill in the art will recognize that additional equations or relationships for determining combination receiver values can be formed and be used without departing from the scope of this disclosure.

Figure 7:
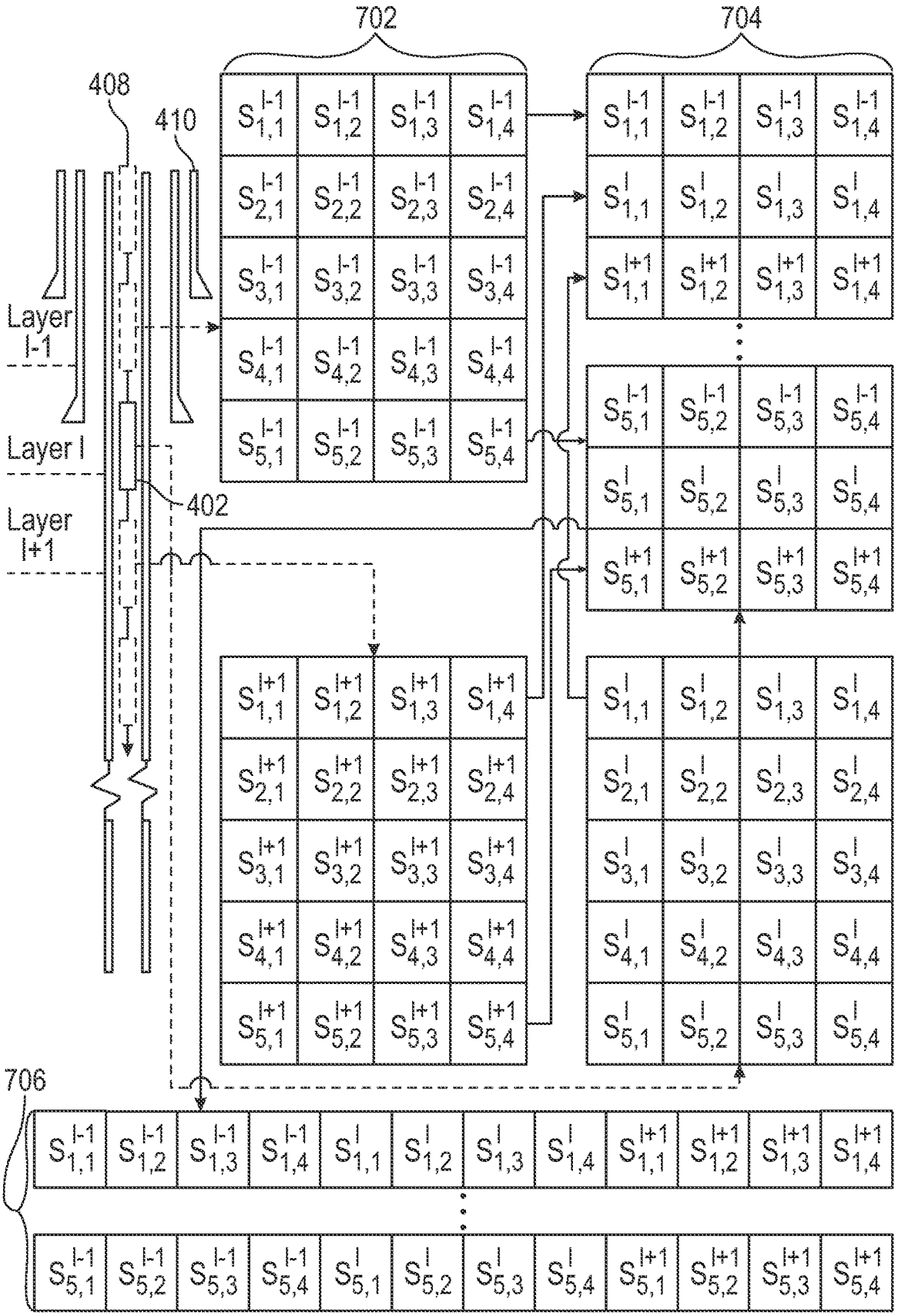
FIG. 7 depicts the structure and manipulation of data acquired by an EM inspection tool, in accordance with one or more embodiments.

In accordance with one or more embodiments, FIG. 7 depicts the acquisition of data as the EM inspection tool (402) progresses through the pipe (410). The EM inspection tool (402) enters the well from the surface and is lowered into the well. Depths of the well are labelled as layers (404). The well is spanned by L layers, where each layer is separated by a uniform layer separation distance (406), di. In accordance with one or more embodiments, when determining the defects in the surrounding pipe (410) at a layer l, combination receiver values may be collected at the layer l and at adjacent layers. In general, the one or more machine-learned models may accept, as inputs, the combination receiver values from the receivers (602) of the N pairs of near- and far-field plates over W number of layers. In accordance with one or more embodiments, when determining the defects in the surrounding pipe (410) at layer l, the combination receiver values are collected for the layers $$l - \left\lfloor \frac{W-1}{2} \right\rfloor \text{ to } l + \left\lceil \frac{W-1}{2} \right\rceil,$$

where $\lfloor \cdot \rfloor$ is the floor operator (round down to nearest integer) and $\lceil \cdot \rceil$ is the ceiling operator (round up to nearest integer). For example, FIG. 7 depicts the acquisition of combination receiver values, $S_{n,m}$, when W=3. In this case, for a layer l, combination receiver values, $S_{n,m}$, are collected for layers l−1, l, and l+1. The collection of combination receiver values over W layers is hereafter referred to as a plurality of receiver measurements. Therefore, in the present example where W=3, L−2 pluralities of receiver measurements may be collected corresponding to layers 2 through L−1 in the well. In the example case of FIG. 7, there are five pairs of near- and far-field plates and each plate contains four receivers (602). Thus, in this example, each plurality of receiver measurements contains W*N*L, or 3*5*4=60 combination receiver values. The layer at which a combination receiver value was recorded for a given receiver can be denoted by a superscript associated with the combination receiver value. That is, when more than one layer is considered, combination receiver values can be uniquely identified with the notation $S_{n,m}^{l}$, where l indicates the layer, n indicates the labelled pair of near- and far-field plates, and m indicates a specific pair of receivers within the $n^{th}$ pair of plates.

In accordance with one or more embodiments, the combination receiver values are standardized according to a set of reference combination receiver values. In one or more embodiments, a plurality of reference receiver measurements is obtained by recording the combination receiver values from within a section of pipe (410) where the pipe (410) is known to be at full thickness and without defects. In the case where the pipe (410) is composed of two or more concentric pipes, each of the concentric pipes is at full thickness and without defects. Because standardization is such a common practice, standardized combination receiver values will simply be referred to as combination receiver values ($S_{n,m}^{l}$) without alteration. In one or more embodiments, a plurality of receiver measurements is standardized by subtracting each originally-recorded combination receiver value from its counterpart in the plurality of reference receiver measurements. Mathematically, this method of standardization is represented as $$S_{n,m}^{l} = \text{S_Ref}_{n,m}^{l} - \text{S_Original}_{m,n}^{l} \forall\, l, m, n, \tag{2}$$

where $S_{n,m}^{l}$ is a standardized combination receiver value, $\text{S_Ref}_{n,m}^{l}$ is the associated reference combination receiver value, and $\text{S_Original}_{m,n}^{l}$ is the original receiver value formed according to EQ. 1. In other embodiments, combination receiver values are standardized by dividing the combination receiver value by the amplitude of the associated reference combination receiver value. In accordance with one or more embodiments, standardization of a plurality of receiver measurements according to a plurality of reference receiver measurements is done as a pre-processing step. Pre-processing, generally defined, encompasses any data preparation, alteration, and/or organization methods applied to the combination receiver values before being processed by the one or more composite machine-learned models.

A plurality of receiver measurements can be organized in a variety of ways. In accordance with one or more embodiments, the combination receiver values of a given plurality of receiver measurements are organized into both a plate data structure (704) and a flattened data structure (706). First, a layer data structure (702) is described. For the layer data structure (702), the combination receiver values are organized into W 2-dimensional arrays, where each array contains the combination receiver values of a single layer. An example of a layer data structure (702) is shown in FIG. 7. As seen, the layer data structure of FIG. 7 is composed of W=3 arrays. Each array corresponds to a single layer and each array containing N*M=5*4=20 combination receiver values. Alternatively, the combination receiver values of a given plurality of receiver measurements can be organized according to near- and far-field plate pairs forming a plate data structure (704). The plate data structure (704) is composed of N 2-dimensional arrays, where the $n^{th}$ array contains the combination receiver values for all the receivers (602) in the $n^{th}$ pair of plates over all W layers. An example of a plate data structure (704), and its relationship to the layer data structure (702) are shown in FIG. 7. The flattened data structure (706) is achieved by simply "flattening" the N 2-dimensional arrays of the plate data structure (704) to form N one-dimensional arrays. An example of a flattened data structure (706) is shown in FIG. 7.

In accordance with one or more embodiments, each composite machine-learned model in the one or more composite machine-learned models will process both a plate data structure (704) and a flattened data structure (706) representation of a given plurality of receiver measurements. As such, in one or more embodiments, a given plurality of receiver measurements is duplicated to form a first copy and a second copy of the plurality of receiver measurements. The first copy and the second copy are each "reshaped" to properly organize the combination receiver values for use by the one or more composite machine-learned models. Specifically, the first copy is reshaped, or organized, into a plate data structure (704) and the second copy is reshaped into a flattened data structure (706). The duplication and subsequent reshaping of a given plurality of receiver measurements may be considered a pre-processing step, in accordance with one or more embodiments.

Figure 8:
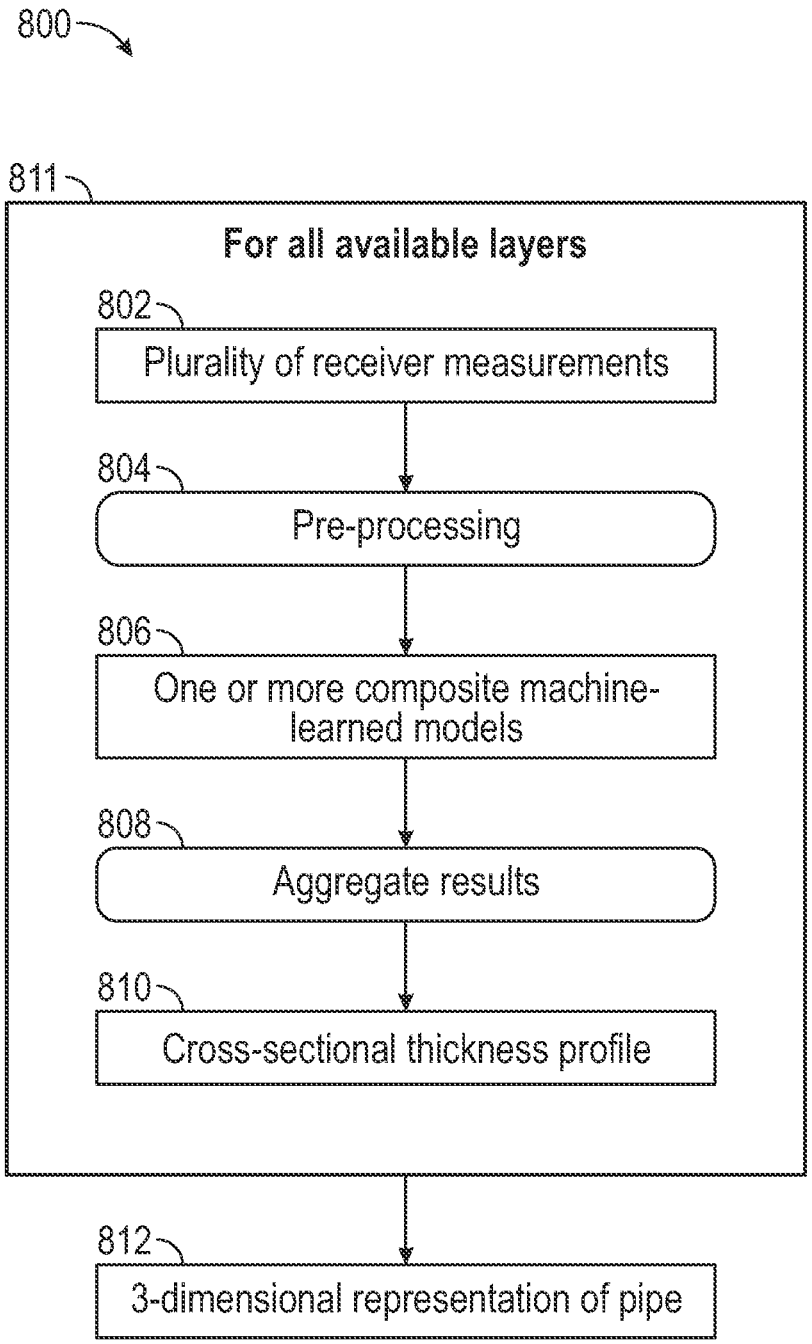
FIG. 8 depicts a workflow, in accordance with one or more embodiments.

FIG. 8 depicts a high-level workflow (800) outlining the use of the EM inspection tool (402) described herein. In Block 802, a plurality of receiver measurements is obtained using the EM inspection tool (402). The plurality of receiver measurements is a collection of original combination receiver values over W layers. The plurality of receiver measurements, while containing original combination receiver values for W layers, corresponds to a single layer. Specifically, for a layer l, the plurality of receiver measurements contains the original combination receiver values for the layers $$l - \left\lfloor \frac{W-1}{2} \right\rfloor$$

to $$l + \left\lceil \frac{W-1}{2} \right\rceil.$$

In Block 804, the plurality of receiver measurements is pre-processed. Pre-processing steps may include, but are not limited to: standardizing the plurality of receiver measurements according to a plurality of reference receiver measurements; duplicating the standardized plurality of receiver measurements to form a first copy and a second copy; and reshaping, or otherwise organizing, the first copy and second copy for use by one or more composite machine-learned models. In Block 804, one or more composite machine-learned models each accept and process the pre-processed plurality of receiver measurements. Each of the one or more composite machine-learned models operates independently from the other composite machine-learned models and each composite machine-learned model produces a result. In Block 808, the one or more results produced by the one or more composite machine-learned models are aggregated. Aggregation can take a variety of forms. In accordance with one or more embodiments, the results are aggregated by taking the average of the results. In other embodiments, the results are aggregated by only retaining a single result and discarding the others. In this case, the retained result may be the one with the highest estimated confidence. One with ordinary skill in the art will recognize that any number of aggregation strategies may be employed without departing from the scope of this disclosure. Once aggregated, the results form a prediction. The prediction is a cross-sectional thickness profile, as shown in Block 810. Understanding that the one or more results will be aggregated into a single prediction, it may be said that the one or more machine-learned models predict a cross-sectional thickness profile. The cross-sectional thickness profile is a 2-dimensional array, or image, which depicts the cross-section of the surrounding pipe (410) at corresponding layer l. The cross-sectional thickness profile illustrates the number, location, and extent of defects in the pipe (410) at layer l. As the EM inspection tool (402) progresses through the well, the processes of collecting a plurality of receiver measurements and predicting a cross-sectional thickness profile can be applied to each available layer. Here, available layer refers to any layer for which a plurality of receiver measurements can be collected. For example, in the case when W=3, layers 2 through L−1 are available. In other embodiments, the pluralities of receiver measurements associated with conventionally unavailable layers may be padded such that all layers 1 through L are available. For example, a plurality of receiver measurements may be padded using the plurality of reference receiver measurements. Block 811 illustrates that a cross-sectional thickness profile is predicted for all available layers. It is noted that each cross-sectional thickness profile corresponds to a specific layer in the well and that the location, or depth, of the layer is known. Further, the orientation of the EM inspection tool (402) with respect to its central longitudinal axis (504), is known by the on-board inertial measurement unit (IMU). As such, in Block 812, the cross-sectional thickness profiles are stitched together, accounting for both depth and orientation, to construct a 3-dimensional representation of the pipe (410).

With the EM inspection tool (402) and an overview of its use described (i.e., high-level workflow (800)), in accordance with one or more embodiments, the one or more composite machine-learned models can be described in greater detail. Machine learning (ML), broadly defined, is the extraction of patterns and insights from data. The phrases "artificial intelligence," "machine learning." "deep learning." and "pattern recognition" are often convoluted, interchanged, and used synonymously throughout the literature. This ambiguity arises because the field of "extracting patterns and insights from data" was developed simultaneously and disjointedly among a number of classical arts like mathematics, statistics, and computer science. For consistency, the term machine learning, or machine-learned, will be adopted herein. However, one with ordinary skill in the art will recognize that the concepts and methods detailed hereafter are not limited by this choice of nomenclature.

Machine-learned model types may include, but are not limited to, generalized linear models, Bayesian regression, random forests, and deep models such as neural networks, convolutional neural networks, and recurrent neural networks. Machine-learned model types, whether they are considered deep or not, are usually associated with additional "hyperparameters" which further describe the model. For example, hyperparameters providing further detail about a neural network may include, but are not limited to, the number of layers in the neural network, choice of activation functions, inclusion of batch normalization layers, and regularization strength. Commonly, in the literature, the selection of hyperparameters surrounding a model is referred to as selecting the model "architecture."

In accordance with one or more embodiments, a cross-sectional thickness profile is predicted using one or more composite machine-learned models. The one or more composite machine-learned models are so named because they are each composed of multiple types of machine-learned models. In accordance with one or more embodiments, a composite machine-learned model contains at least one neural network (NN), at least one convolutional neural network (CNN), and at least one long short-term memory (LSTM) network. For greater context, the basic operations of a NN, CNN, and LSTM are described below. However, one with ordinary skill in the art will recognize that many variations of each of these machine-learned models exist. As such, the introductory discussions of a NN, CNN, and LSTM provided herein should not be construed as limiting on the instant disclosure.

Figure 9:
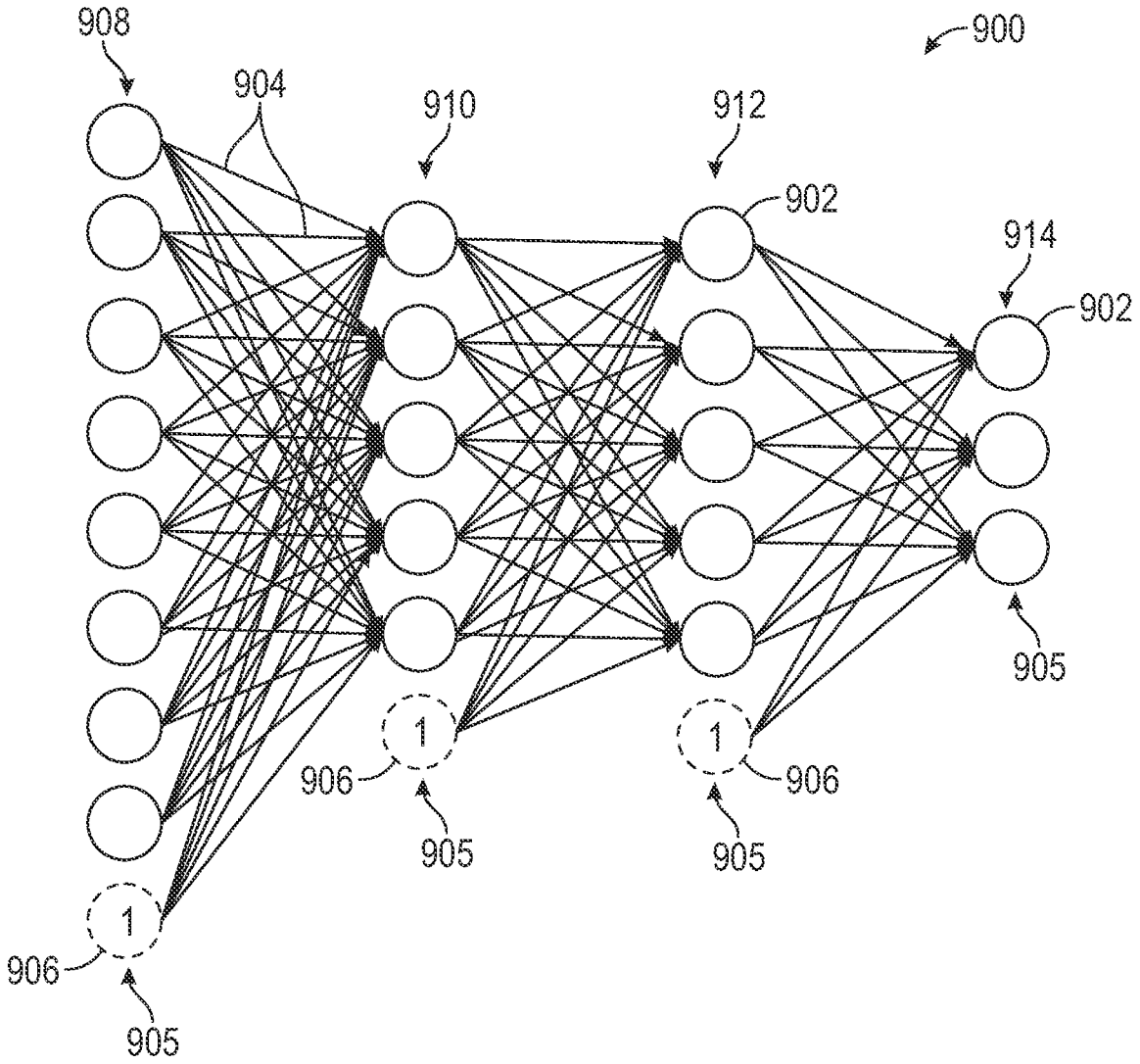
FIG. 9 depicts a neural network, in accordance with one or more embodiments.

A diagram of a neural network (NN) (900) is shown in FIG. 9. At a high level, a NN (900) may be graphically depicted as being composed of nodes (902), where here any circle represents a node, and edges (904), shown here as directed lines. The nodes (902) may be grouped to form layers (905). FIG. 9 displays four layers (908, 910, 912, 914) of nodes (902) where the nodes (902) are grouped into columns, however, the grouping need not be as shown in FIG. 9. The edges (904) connect the nodes (902). Edges (904) may connect, or not connect, to any node(s) (902) regardless of which layer (905) the node(s) (602) is in. That is, the nodes (902) may be sparsely and residually connected. A neural network (900) will have at least two layers (905), where the first layer (908) is considered the "input layer" and the last layer (914) is the "output layer." Any intermediate layer (910, 912) is usually described as a "hidden layer." A neural network (900) may have zero or more hidden layers (910, 912) and a neural network (600) with at least one hidden layer (910, 912) may be described a "deep" neural network or a "deep learning method." In general, a neural network (900) may have more than one node (902) in the output layer (914). In this case the neural network (900) may be referred to as a "multi-target" or "multi-output" network.

Nodes (902) and edges (904) carry additional associations. Namely, every edge (904) is associated with a numerical value. The edge numerical values, or even the edges (904) themselves, are often referred to as "weights" or "parameters." While training a neural network (900), numerical values are assigned to each edge (904). Additionally, every node (902) is associated with a numerical variable and an activation function. Activation functions are not limited to any functional class, but traditionally follow the form $$A = f\left(\sum_{i \in (incoming)} [(\text{node value})_i (\text{edge value})_i]\right), \quad (3)$$

where i is an index that spans the set of "incoming" nodes (902) and edges (904) and $f$ is a user-defined function. Incoming nodes (902) are those that, when viewed as a graph (as in FIG. 9), have directed arrows that point to the node (902) where the numerical value is being computed. Some functions for $f$ may include the linear function $f(x)=x$, sigmoid function $$f(x) = \frac{1}{1+e^{-x}},$$

and rectified linear unit (ReLU) function $f(x)=\max(0, x)$, however, many additional functions are commonly employed. Every node (902) in a neural network (900) may have a different associated activation function. Often, as a shorthand, activation functions are described by the function $f$ by which it is composed. That is, an activation function composed of a linear function $f$ may simply be referred to as a linear activation function without undue ambiguity.

When the neural network (900) receives a network input, the network input is propagated through the network according to the activation functions and incoming node (902) values and edge (904) values to compute a value for each node (902) according to EQ. 3. That is, the numerical value for each node (902) may change for each received input. Occasionally, nodes (902) are assigned fixed numerical values, such as the value of 1, that are not affected by the input or altered according to edge (904) values and activation functions. Fixed nodes (902) are often referred to as "biases" or "bias nodes" (906), displayed in FIG. 9 with a dashed circle.

In some implementations, the neural network (900) may contain specialized layers (905), such as a normalization layer, a regularization layer (e.g. dropout layer), and a concatenation layer. One skilled in the art will appreciate that these alterations do not exceed the scope of this disclosure.

As noted, the training procedure for the neural network (900) comprises assigning values to the edges (904). To begin training, the edges (904) are assigned initial values. These values may be assigned randomly, assigned according to a prescribed distribution, assigned manually, or by some other assignment mechanism. Once edge (904) values have been initialized, the neural network (900) may act as a function, such that it may receive inputs and produce an output. As such, at least one input is propagated through the neural network (900) to produce an output. Generally, a dataset, known as a training dataset, is provided to the neural network (900) in order for the network to learn edge (904) values (i.e., learn the network parameters). The training dataset is composed of inputs and associated target(s), where the target(s) represent the "ground truth", or the otherwise desired output. The neural network (900) output is compared to the associated input data target(s). The comparison of the neural network (900) output to the target(s) is typically performed by a so-called "loss function"; although other names for this comparison function such as "error function." "misfit function," and "cost function" are commonly employed. Many types of loss functions are available, such as the mean-squared-error function, however, the general characteristic of a loss function is that the loss function provides a numerical evaluation of the similarity between the neural network (900) output and the associated target(s). The loss function may also be constructed to impose additional constraints on the values assumed by the edges (904), for example, by adding a penalty term, which may be physics-based, or a regularization term. Generally, the goal of a training procedure is to alter the edge (904) values to promote similarity between the neural network (900) output and associated target(s) over the training dataset. Thus, the loss function is used to guide changes made to the edge (904) values, typically through a process called "backpropagation."

While a full review of the backpropagation process exceeds the scope of this disclosure, a brief summary is provided. Backpropagation consists of computing the gradient of the loss function over the edge (904) values. The gradient indicates the direction of change in the edge (904) values that results in the greatest change to the loss function. Because the gradient is local to the current edge (904) values, the edge (904) values are typically updated by a "step" in the direction indicated by the gradient. The step size is often referred to as the "learning rate" and need not remain fixed during the training process. Additionally, the step size and direction may be informed by previously seen edge (904) values or previously computed gradients. Such methods for determining the step direction are usually referred to as "momentum" based methods.

Once the edge (904) values have been updated, or altered from their initial values, through a backpropagation step, the neural network (900) will likely produce different outputs. Thus, the procedure of propagating at least one input through the neural network (900), comparing the neural network (900) output with the associated target(s) with a loss function, computing the gradient of the loss function with respect to the edge (904) values, and updating the edge (904) values with a step guided by the gradient, is repeated until a termination criterion is reached. Common termination criteria are: reaching a fixed number of edge (904) updates, otherwise known as an iteration counter; a diminishing learning rate; noting no appreciable change in the loss function between iterations; reaching a specified performance metric as evaluated on the data or a separate hold-out data set. Once the termination criterion is satisfied, and the edge (904) values are no longer intended to be altered, the neural network (900) is said to be "trained."

As previously stated, another component of each of the one or more composite machine-learned models is a convolutional neural network (CNN). A CNN is similar to a neural network (900) in that it can technically be graphically represented by a series of edges (904) and nodes (902) grouped to form layers. However, it is more informative to view a CNN as structural groupings of weights; where here the term structural indicates that the weights within a group have a relationship. CNNs are widely applied when the data inputs also have a structural relationship, for example, a spatial relationship where one input is always considered "to the left" of another input. Images, for example, have such a structural relationship as the spatial location of any pixel may be defined relative to the other pixels in an image. Consequently, CNNs are particularly apt at processing images. The plate data structure (704) encodes a relationship between the receivers (602) in the EM inspection tool (402) and the layers at which the plurality of receiver measurements are obtained.

A structural grouping, or group, of weights is herein referred to as a "filter." The number of weights in a filter is typically much less than the number of inputs. In a CNN, the filters can be thought as "sliding" over, or convolving with, the inputs to form an intermediate output or intermediate representation of the inputs which still possesses a structural relationship. Like unto the neural network (900), the intermediate outputs are often further processed with an activation function. Many filters may be applied to the inputs to form many intermediate representations. Additional filters may be formed to operate on the intermediate representations creating more intermediate representations. This process may be repeated as prescribed by a user. Eventually, there is a "final" group of intermediate representations, wherein no more filters act on these intermediate representations. Generally, the structural relationship of the final intermediate representations is ablated; a process known as "flattening." The flattened representation can be passed to another machine-learned model such as a neural network (900) to produce the final output. Like unto a neural network (900), a CNN is trained, after initialization of the filter weights, with the backpropagation process in accordance with a loss function.

In accordance with one or more embodiments, another component of each of the one or more composite machine-learned models is a long short-term memory (LSTM) network. To best understand a LSTM network, it is helpful to describe the more general recurrent neural network (RNN), for which an LSTM may be considered a specific implementation.

Figure 10A:
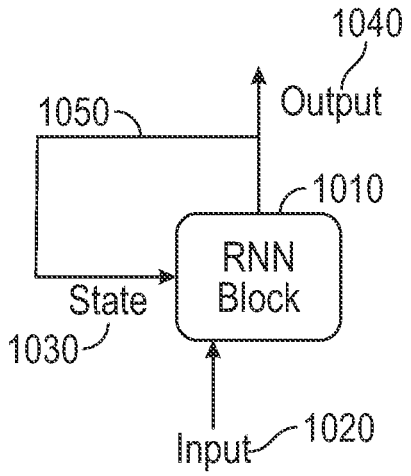
FIG. 10A depicts a recurrent neural network, in accordance with one or more embodiments.

FIG. 10A depicts the general structure of a recurrent neural network (RNN). An RNN is graphically composed of an RNN Block (1010) and a recurrent connection (1050). The RNN Block may be thought of as a function which accepts an Input (1020) and a State (1030) and produces an Output (1040). Without loss of generality, such a function may be written as $$\text{Output} = RNN \text{ Block (Input, State)}. \tag{4}$$

The RNN Block (1010) generally comprises one or more matrices and one or more bias vectors. The elements of the matrices and bias vectors are commonly referred to as "weights" or "parameters" in the literature such that the matrices may be referenced as weight matrices or parameter matrices without ambiguity. The weights of the RNN are analogous in function to those of the NN (900) and the CNN. It is noted that for situations with higher dimensional inputs (e.g. inputs with a tensor rank greater than or equal to 2), the weights of an RNN Block (1010) may be contained in higher order tensors, rather than in matrices or vectors. For clarity, the present example will consider Inputs (1020) as vectors or as scalars such that the RNN Block (1010) comprises one or more weight matrices and bias vectors, however, one with ordinary skill in the art will appreciate that this choice does not impose a limitation on the present disclosure. Typically, an RNN Block (1010) has two weight matrices and a single bias vector which are distinguished with an arbitrary naming nomenclature. A commonly employed naming convention is to call one weight matrix W and the other U and to reference the bias vector as $\vec{b}$.

An important aspect of an RNN is that it is intended to process sequential, or ordered, data; for example, a time-series. The flattened data structure (706) representation of the plurality of receiver measurements can be considered a sequence. That is, these data structures effectively encode phase information into the receiver measurements acquired by the EM inspection tool (402). In the RNN, the Input (520) may be considered a single part of a sequence. As an illustration, consider a sequence composed of Y parts. Each part may be considered an input, indexed by t, such that the sequence may be written as sequence=[$\text{input}_1$, $\text{input}_2$, $\text{input}_t$, . . . , $\text{input}_{Y-1}$, $\text{input}_Y$]. Each Input (1020) (e.g., $\text{input}_1$ of a sequence) may be a scalar, vector, matrix, or higher-order tensor. For the present example, as previously discussed, each Input (1020) is considered a vector with j elements. In the case where j=1, each Input (1020) is a scalar. To process a sequence, an RNN receives the first ordered Input (1020) of the sequence, $\text{input}_1$, along with a State (1030), and processes them with the RNN Block (1010) according to EQ. 4 to produce an Output (1040). The Output (1040) may be a scalar, vector, matrix, or tensor of any rank. For the present example, the Output (1040) is considered a vector with k elements. The State (1030) is of the same type and size as the Output (1040) (e.g., a vector with k elements). For the first ordered input, the State (1030) is usually initialized with all of its elements set to the value zero. For the second ordered Input (1020), $\text{input}_2$, of the sequence, the Input (1020) is processed similarly according to EQ. 4, however, the State (1030) received by the RNN Block (1010) is set to the value of the Output (1040) determined when processing the first ordered Input (1020). This process of assigning the State (1030) the value of the last produced Output (1040) is depicted with the recurrent connection (1050) in FIG. 10A. All the Inputs (1020) in a sequence are processed by the RNN Block (1010) in this manner; that is, the State (1030) associated with an Input (1020) is the Output (1040) of the RNN Block (1010) produced by the previous Input (1020) (with the exception of the first Input (1020) in the sequence). In some implementations, each Output (1040), one for each Input (1010) within a sequence, is stored for later processing and use. In other implementations, only the final Output (1040), or the Output (1040) which is produced when the Input (1020) $\text{input}_Y$ is processed by the RNN Block (1010), is retained.

In greater detail, the process of the RNN Block (1010), or EQ. 4, may be generally written as $$\text{Output} = RNN \text{ Block (input, state)} = f\left(U \cdot \text{state} + W \cdot \text{input} + \vec{b}\right), \tag{5}$$

where W, U, and $\vec{b}$ are the weight matrices and bias vector of the RNN Block (510), respectively, and $f$ is an "activation function." Some functions for $f$ may include the sigmoid function $$f(x) = \frac{1}{1 + e^{-x}},$$

and rectified linear unit (ReLU) function $f(x)=\max(0, x)$, however, many additional functions are commonly employed.

To further illustrate a RNN, a pseudo-code implementation of a RNN is as follows.

RNN Algorithm

```
Note:
j = input length
k = output length
```

-continued

| RNN Algorithm |
|---|
| $W \in \mathbb{R}^{k \times k}$ |
| $U \in \mathbb{R}^{k \times j}$ |
| $\vec{b} \in \mathbb{R}^{k}$ |
| 1: state = $[0_1, 0_2, \ldots, 0_{k-1}, 0_k]^T$ |
| 2: for input in sequence: |
| 3: $\vec{z}_1$ = matmul(U, state) |
| 4: $\vec{z}_2$ = matmul(W, input) |
| 5: output = f ($\vec{z}_1 + \vec{z}_2 + \vec{b}$) |
| 6: state = output |

In keeping with the previous examples, both the inputs and the outputs are considered vectors of lengths j and k, respectively, however, in general, this need not be the case. With the lengths of these vectors defined, the shapes of the weight matrices, bias vector, and State (1030) vector may be specified. To begin processing a sequence, the State (1030) vector is initialized with values of zero as shown in line 1 of the pseudo-code. Note that in some implementations, the number of inputs contained within a sequence may not be known or may vary between sequences. One with ordinary skill in the art will recognized that an RNN may be implemented without knowing, beforehand, the length of the sequence to be processed. This is demonstrated in line 2 of the pseudo-code by indicating that each input in the sequence will be processed sequentially without specifying the number of inputs in the sequence. Once an Input (1020) is received, a matrix multiplication operator is applied between the weight matrix U and the State (1030) vector. The resulting product is assigned to the temporary variable $\vec{z}_1$. Likewise, a matrix multiplication operator is applied between the weight matrix W and the Input (1010) with the result assigned to the variable $\vec{z}_2$. For the present example, due the Input (1020) and Output (1040) each being defined as vectors, the products in lines 3 and 4 of the pseudo-code may be expressed as matrix multiplications, however, in general, the dot product between the weight matrix and corresponding State (1030) or Input (1020) may be applied. The Output (1040) is determined by summing $\vec{z}_1$. $\vec{z}_2$, and the bias vector $\vec{b}$ and applying the activation function $f$ elementwise. The State (1030) is set to the Output (1040) and the whole process is repeated until each Input (1020) in a sequence has been processed.

Figure 10B:
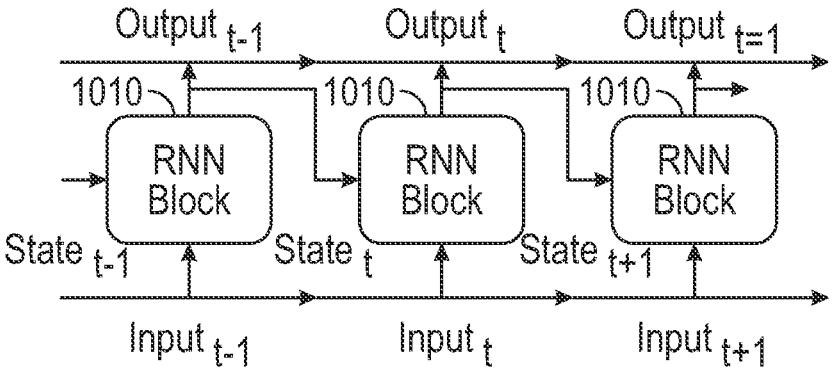
FIG. 10B depicts an unrolled recurrent neural network, in accordance with one or more embodiments.

FIG. 10B depicts an "unrolled" version of the RNN of FIG. 10A. Unrolling the RNN allows one to see how the sequential inputs, indexed by t, produce sequential outputs and how the state is passed through various inputs of the sequence. It is noted that while the "unrolled" depiction shows multiple RNN Blocks (1010), these blocks are the same such that they are comprised of the same weight matrices and bias vector.

As previously stated, generally, training a machine-learned model requires that pairs of inputs and one or more targets (i.e., a training dataset) are passed to the machine-learned model. During this process the machine-learned model "learns" a representative model which maps the received inputs to the associated outputs. In the context of an RNN, the RNN receives a sequence, wherein the sequence can be partitioned into one or more sequential parts (Inputs (1020) above), and maps the sequence to an overall output, which may also be a sequence. To remove ambiguity and distinguish the overall output of an RNN from any intermediate Outputs (1040) produced by the RNN Block (1010), the overall output will be referred to herein as a RNN result. In other words, an RNN receives a sequence and returns a RNN result. The training procedure for a RNN comprises assigning values to the weight matrices and bias vector of the RNN Block (1010). For brevity, the elements of the weight matrices and bias vector will be collectively referred to as the RNN weights. To begin training the RNN weights are assigned initial values. These values may be assigned randomly, assigned according to a prescribed distribution, assigned manually, or by some other assignment mechanism. Once the RNN weights have been initialized, the RNN may act as a function, such that it may receive a sequence and produce a RNN result. As such, at least one sequence may be propagated through the RNN to produce a RNN result. For training, a training dataset is composed of one or more sequences and desired RNN results, where the desired RNN results represent the "ground truth", or the true RNN results that should be returned for the given sequences. For clarity, and consistency with previous discussions of machine-learned model training, the desired or true RNN results will be referred to as targets. When processing sequences, the RNN result produced by the RNN is compared to the associated target. The comparison of a RNN result to the target(s) is typically performed by a loss function. As before, other names for this comparison function such as "error function" and "cost function" are commonly employed. Many types of loss functions are available, such as the mean squared error function, however, the general characteristic of a loss function is that the loss function provides a numerical evaluation of the similarity between the RNN result and the associated target(s). The loss function may also be constructed to impose additional constraints on the values assumed by RNN weights, for example, by adding a penalty term, which may be physics-based, or a regularization term. Generally, the goal of a training procedure is to alter the RNN weights to promote similarity between the RNN results and associated targets over the training dataset. Thus, the loss function is used to guide changes made to the RNN weights, typically through a process called "backpropagation through time," which is similar to the backpropagation process previously described.

Figure 10C:
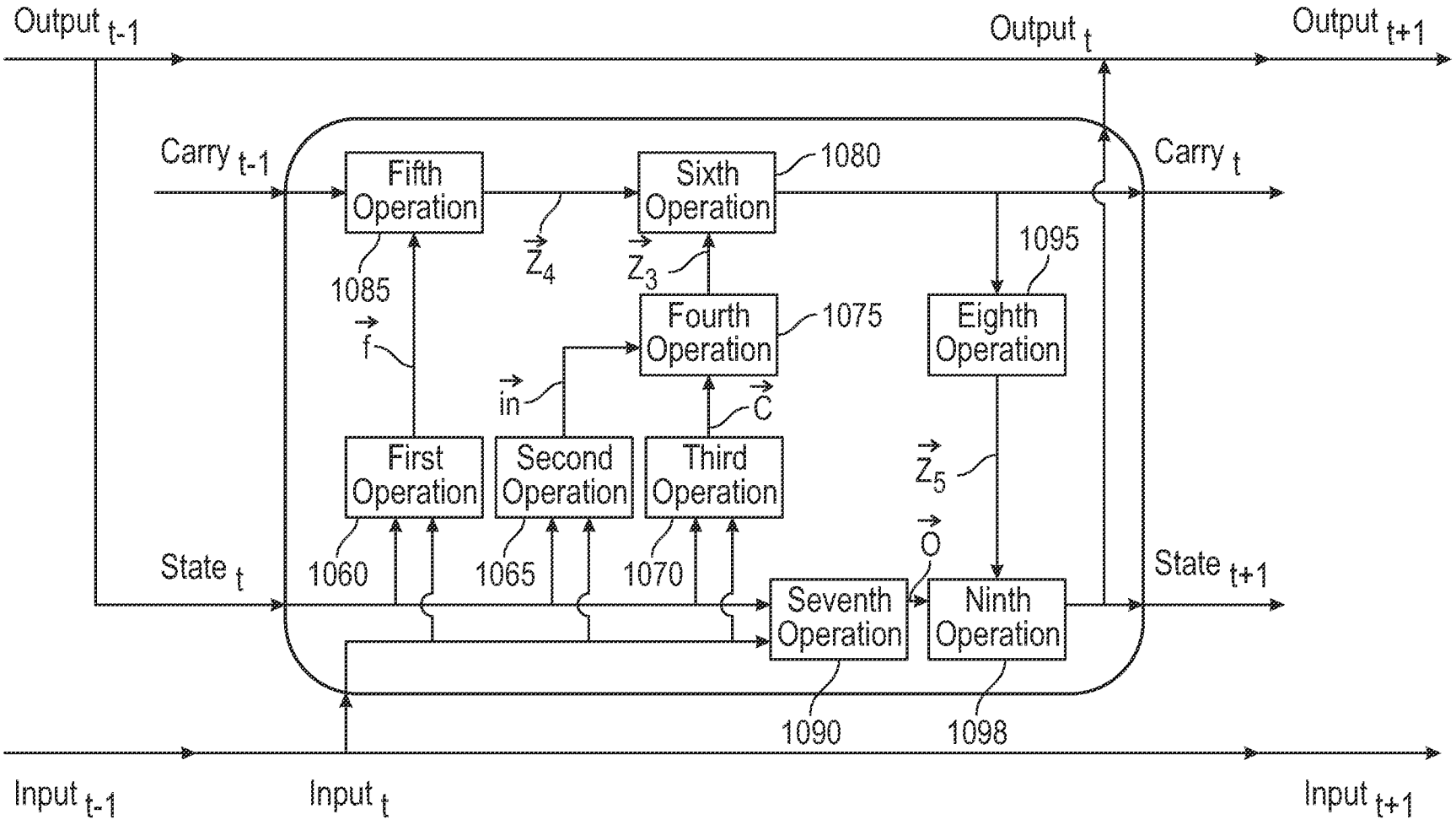
FIG. 10C depicts a long short-term memory network, in accordance with one or more embodiments.

A long short-term memory (LSTM) network may be considered a specific, and more complex, instance of a recurrent neural network (RNN). FIG. 10C is an unrolled depiction of a LSTM where the internal components of the LSTM are displayed as labelled abstractions. A LSTM, like a RNN, has a recurrent connection, such that the output produced by a single input in a sequence is forwarded as the state to be used with the subsequent input. However, an LSTM also possesses another "state-like" data structure commonly referred to as the "carry." The carry, like the state and input may be a scalar, vector, matrix, or tensor of any rank depending on the context of the application. Like unto the description of the RNN, for simplicity, the carry will be considered a vector in the following discussion of the LSTM. The LSTM receives an input, state, and carry and produces an output and a new carry. The output and the new carry are passed to the LSTM as the state and carry for the subsequent input. This sequential process, indexed by t, may be described functionally as $$(\text{output}_t, \text{carry}_t) = \textit{LSTM}\ \text{Block}\ (\text{input}_t, \text{carry}_{t-1}, \text{state}_t) = \textit{LSTM}\ \text{Block}\ (\text{input}_t, \text{carry}_{t-1}, \text{output}_{t-1}), \quad (6)$$

where the LSTM Block, like the RNN Block, comprises one or more weight matrices and bias vectors and the processing steps necessary to transform an input, state, and carry to an output and new carry.

LSTMs may be configured in a variety of ways, however, the processes depicted in FIG. 5C are the most common. As shown in FIG. 10C, an LSTM Block receives an input ($\text{input}_t$), a state ($\text{state}_t$), and a carry ($\text{carry}_{t-1}$). Again, assuming that the inputs, carry, and outputs are all vectors, the weights of the LSTM Block may be considered to reside in eight matrices and four bias vectors. These matrices and vectors are conventionally named $W_i$, $U_i$, $W_f$, $U_f$, $W_c$, $U_c$, $W_o$, $U_o$ and $\vec{b}_i$, $\vec{b}_f$, $\vec{b}_c$, $\vec{b}_o$, respectively. The processes of the LSTM Block are as follows. Block 1060 represents the following first operation $$\vec{f} = a_1\left(U_f \cdot \text{state}_t + W_f \cdot \text{input}_t + \vec{b}_f\right),$$

where $a_1$ is an activation function applied elementwise to the result of the parenthetical expression and the resulting vector is $\vec{f}$. Block 1065 implements the following second operation $$\vec{i} = a_2\left(U_i \cdot \text{state}_t + W_i \cdot \text{input}_t + \vec{b}_i\right),$$

where $a_2$ is an activation function which may be the same or different to $a_1$ and is applied elementwise to the result of the parenthetical expression. The resulting vector is $\vec{i}$. Block 1070 implements the following third operation $$\vec{c} = a_3\left(U_c \cdot \text{state}_t + W_c \cdot \text{input}_t + \vec{b}_c\right),$$

where $a_3$ is an activation function which may be the same or different to either $a_1$ or $a_2$ and is applied elementwise to the result of the parenthetical expression. The resulting vector is $\vec{c}$. In block 1075, vectors $\vec{i}$ and $\vec{c}$ are multiplied according to a fourth operation $$\vec{z}_3 = \vec{i} \odot \vec{c},$$

where $\odot$ indicates the Hadamard product (i.e., elementwise multiplication). Likewise, in block 1085 the carry vector from the previous sequential input ($\text{carry}_{t-1}$) vector and the vector $\vec{f}$ are multiplied according to a fifth operation $$\vec{z}_4 = \text{carry}_{t-1} \odot \vec{f}.$$

The results of the operations of blocks 1075 and 1085 ($\vec{z}_3$ and $\vec{z}_4$, respectively) are added together in block 1080, a sixth operation, to form the new carry ($\text{carry}_t$);

$$\text{carry}_t = \vec{z}_3 + \vec{z}_4.$$

In block 1090, the current input and state vectors are processed according to a seventh operation $$\vec{o} = a_4\left(U_o \cdot \text{state}_t + W_o \cdot \text{input}_t + \vec{b}_o\right),$$

where $a_4$ is an activation function which may be unique or identical to any other used activation function and is applied elementwise to the result of the parenthetical expression. The result is the vector $\vec{o}$. In block 1095, an eighth operation, the new carry ($\text{carry}_t$) is passed through an activation function $a_5$. The activation $a_5$ is usually the hyperbolic tangent function but may be any known activation function. The eighth operations (block 1095) may be represented as $$\vec{z}_5 = a_5(\text{carry}_t).$$

Finally, the output of the LSTM Block ($\text{output}_t$) is determined in block 1098 by taking the Hadamard product of $\vec{z}_5$ and $\vec{o}$, a ninth operation shown mathematically as $$\text{output}_t = \vec{z}_5 \odot \vec{o}.$$

The output of the LSTM Block is used as the state vector for the subsequent input. Again, as in the case of the RNN, the outputs of the LSTM Block applied to a sequence of inputs may be stored and further processed or, in some implementations, only the final output is retained. While the processes of the LSTM Block described above used vector inputs and outputs, it is emphasized that an LSTM network may be applied to sequences of any dimensionality. In these circumstances the rank and size of the weight tensors will change accordingly. One with ordinary skill in the art will recognized that there are many alterations and variations that can be made to the general LSTM structure described herein, such that the description provided does not impose a limitation on the present disclosure.

Figure 11:
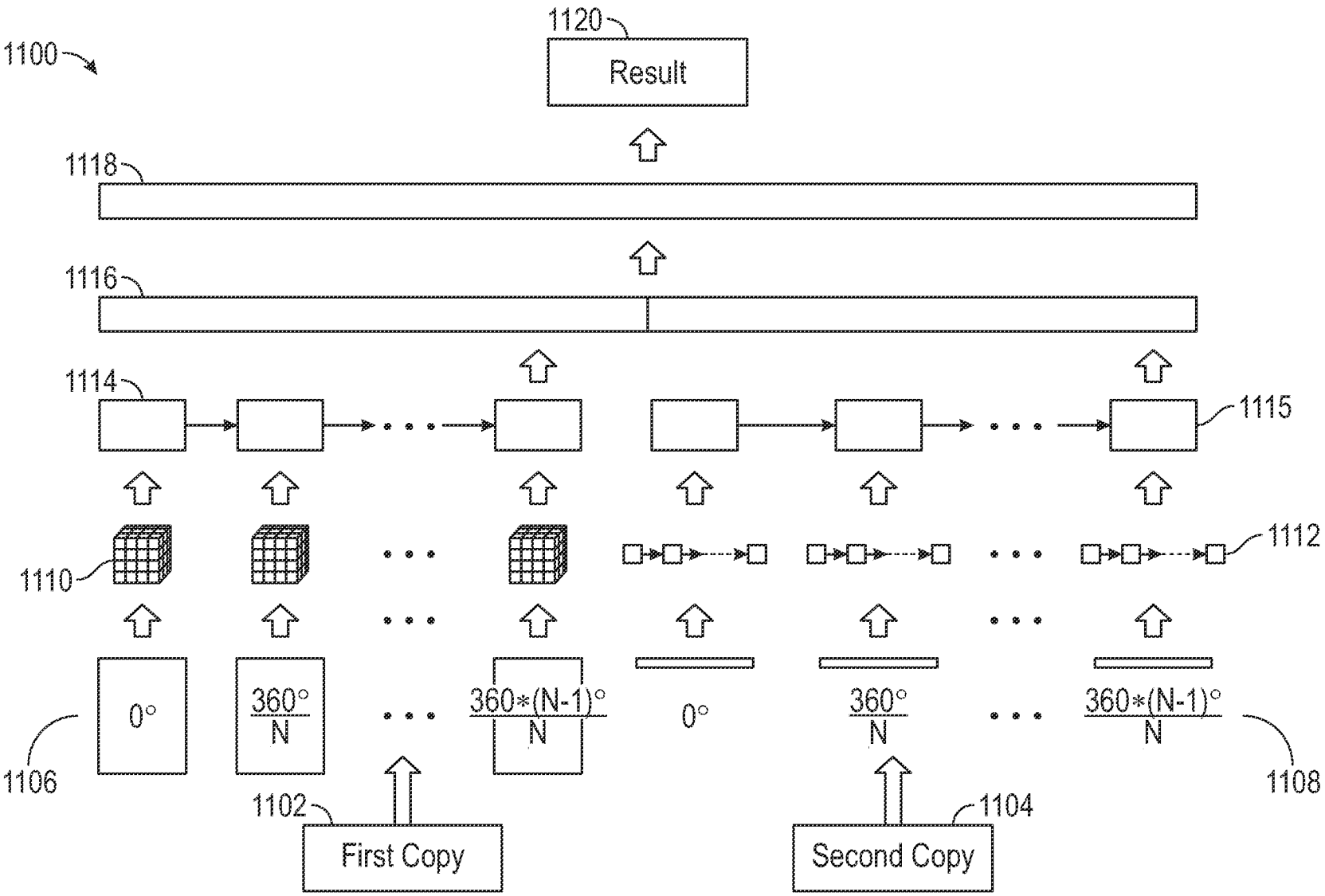
FIG. 11 depicts a composite machine-learned model, in accordance with one or more embodiments.

With the building blocks of the one or more composite machine-learned models described, FIG. 11 depicts a composite machine-learned model (1100) in accordance with one or more embodiments. As seen, the composite machine-learned model (1100) is composed of at least one CNN, at least one LSTM, and at least one NN. The composite machine-learned model (1100) may be considered a function which accepts an input and produces and output. The composite machine-learned model (1100) accepts a plurality of receiver measurements as an input. The receiver measurements are complex, containing both a real and an imaginary component. The composite machine-learned model (1100) may be configured to accept the complex values as inputs. In one or more embodiments, the real and imaginary portions are separated and fed to the composite machine-learned model as individual inputs. In other embodiments, the real and imaginary components are retained together through an added dimension to the input. For example, if receiver measurements are structured as a 2D array, then the real and imaginary components may be retained together by expanding the array to three dimensions. The composite machine-learned model (1100) accepts a first copy (1102) and a second copy (1104) of the plurality of receiver measurements where the first copy (1102) has been reshaped according to the plate data structure (704) and the second copy (1104) has been reshaped according to the flattened data structure (706). In one or more embodiments, the combination receiver values of the first copy (1102) and the second copy (1104) are standardized. The first copy (1102) is accepted by the composite machine-learned model (1100) though a 2D input layer (1106). The second copy (1104) is accepted by the composite machine-learned model (1100) through a 1D input layer (1108). The 2D input layer (1106) is processed by one or more convolutional neural networks (CNNs) (1110).

In accordance with one or more embodiments, the 2D input layer (1106) is processed by a single CNN (1110), where each of the N 2-dimensional arrays in the plate data structure (704) are considered channels of the 2D input layer (1106). In one or more embodiments, the 2D input layer (1106) is processed by N CNNs (1110), where each CNN accepts one of the N 2-dimensional arrays in the plate data structure (704). In one or more embodiments, each of the N 2-dimensional arrays in the plate data structure (704) is processed by a single CNN (1110) individually. That is, the same CNN (1110) is applied to each of the N 2-dimensional arrays in parallel.

In accordance with one or more embodiments, the 1D input layer (1108) is processed by a first LSTM (1112). In one or more embodiments, the first LSTM (1112) includes N individual LSTMs. In this case, the 1D input layer (1108) is processed by N LSTMs (1112), where each LSTM accepts a 1-dimensional sequence. Under the flattened data structure (706), N 1-dimensional sequences exist. In one or more embodiments, each of the N 1-dimensional arrays in the flattened data structure (706) is processed by a single LSTM (1112) individually. That is, the same LSTM (1112) is applied to each of the N 1-dimensional arrays in parallel.

The output of the one or more CNNs (1110) in the composite machine-learned model (1100) is collected as a sequence and provided as an input to a second LSTM (1114). Likewise, the output of the first LSTM (1112), whether the first LSTM (1112) is a single LSTM or is composed of N LSTMs, is collected as a sequence and provided as an input to a third LSTM (1115). The final outputs of the second LSTM (1114) and the third LSTM (1115) are concatenated together via a concatenation layer (1116). The concatenation layer is fed as an input into a densely connected neural network (1118). The densely connected neural network (1118) is multi-output. In general, the output layer of the densely connected neural network (1118) contains R*C nodes. In accordance with one or more embodiments, each of the nodes in the output layer of the densely connected neural network (1118) is processed with a sigmoid activation function. The output layer is reshaped to form a 2-dimesional image of R rows and C columns known as a Result (1120). The Result (1120) is an image where each of the pixels (or nodes after being reshaped) indicates the amount of metal (i.e., pipe material), or lack of metal, at the spatial location associated with the pixel. Thus, the Result (1120) visualizes surrounding pipe (410) and its defects at the layer corresponding with the plurality of receiver measurements given as an input to the composite machine-learned model (1100). Note, that in one or more embodiments, the value of each node in the Result (1120) may be converted to a binary value by comparison to a user-defined threshold.

Figure 12:
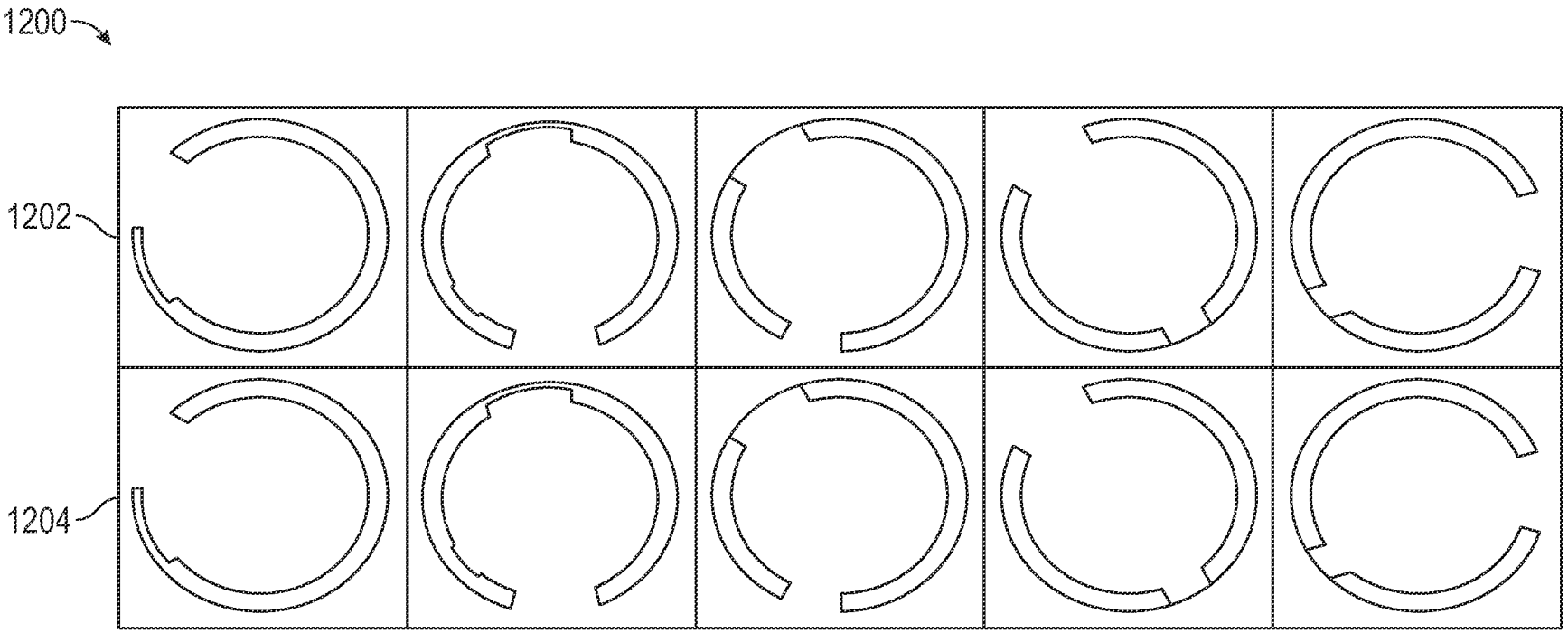
FIG. 12 depicts cross-sectional thickness profiles, in accordance with one or more embodiments.

Each of the one or more composite machine-learned models is constructed after the manner shown in FIG. 11. That is, the architecture of each of the one or more composite machine-learned models is the same. However, each of the one or more composite machine-learned models is trained with a unique alteration of the training dataset. The training dataset, and its alterations, will be described in greater detail later in the instant disclosure. Each of the one or more composite machine-learned models produces a Result (1120). The results are aggregated to form a cross-sectional thickness profile. FIG. 12 depicts five example cross-sectional thickness profiles (1200). For each of the example cross-sectional thickness profiles (1200) in FIG. 12, the ground truth profile (1204), or the actual cross section of the pipe (410) at the associated layer is known. For each of the cross-sections of the pipe, a plurality of receiver measurements was obtained by the EM inspection tool (402). These pluralities of receiver measurements were each processed by the one or more composite machine-learned models, with results aggregated across the one or more composite machine-learned models, to produce the predicted profiles (1202). As seen in FIG. 12, the predicted profiles (1202) demonstrate close alignment with the ground truth profiles (1204) in terms of locating the defects (areas of corrosion) on the surrounding pipe (410). Further, the predicted profiles (1202) detail the number, location, and extent of defects on the pipe (410). The ability to image the cross-section of the surrounding pipe (410) with an EM inspection tool (402) is a significant improvement over the state-of-the-art methods that can only determine the total circumferential or average circumferential thickness of the pipe (410). This improvement is obtained through the careful structuring of the EM inspection tool (410) (i.e., the arrangement of the near- and far-field plates and receivers), the organization of the plurality of receiver measurements, and the architecture of the one or more composite machine-learned models described herein.

Figure 13:
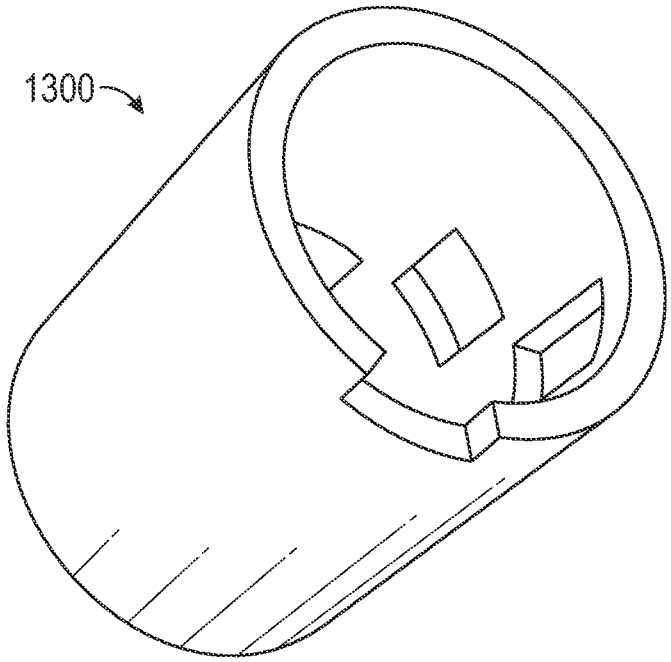
FIG. 13 depicts a 3-dimensional representation of a pipe, in accordance with one or more embodiments.

The predicted profiles (1202) of adjacent layers, along with knowledge of the orientation of the EM inspection tool (402) relative to its central longitudinal axis (504), may be stitched (or stacked) together to form a 3-dimensional representation of the surrounding pipe (410). An example 3D representation (1300) of a pipe (410) is depicted in FIG. 13. A further advantage of the EM inspection tool (402), methods, and models described herein is that the connectivity of defects across layers can be determined using the 3-dimensional representation of a pipe (410). Evaluation of how defects are connected yields information regarding how one or more defects may have formed. For example, a 3-dimensional representation may indicate a longitudinal crack in the pipe (410) caused by stress. The stress may be the result of wellbore collapse or formation compression.

Each of the one or more composite machine-learned models must be trained before use. To train each of these models a training dataset is generated. The training dataset is generated synthetically using a forward model applied to many simulated pipes each with various defects. To model the electromagnetic (EM) radiation, the forward modeling process requires governing equations. Specifically, the Maxwell equations are used. The Maxwell equations are given as $$\nabla \cdot E = \frac{\rho}{\epsilon_0}, \tag{7}$$

$$\nabla \cdot B = 0, \tag{8}$$

$$\nabla \times E = -\frac{\partial}{\partial t} B, \text{ and} \tag{9}$$

$$\nabla \times B = \mu_0 J + \mu_0 \varepsilon_0 \frac{\partial}{\partial t} E, \tag{10}$$

where E and B represent the electric and magnetic fields, respectively, $\rho$ is the charge density, $\epsilon_0$ is the permittivity of free space, $\mu_0$ is the permeability of free space, and J is the current density. The Maxwell equations can be applied to model the interaction of the EM signal transmitted by the one or more transmitters of the EM inspection tool (402) and a surrounding pipe (410).

Figure 14:
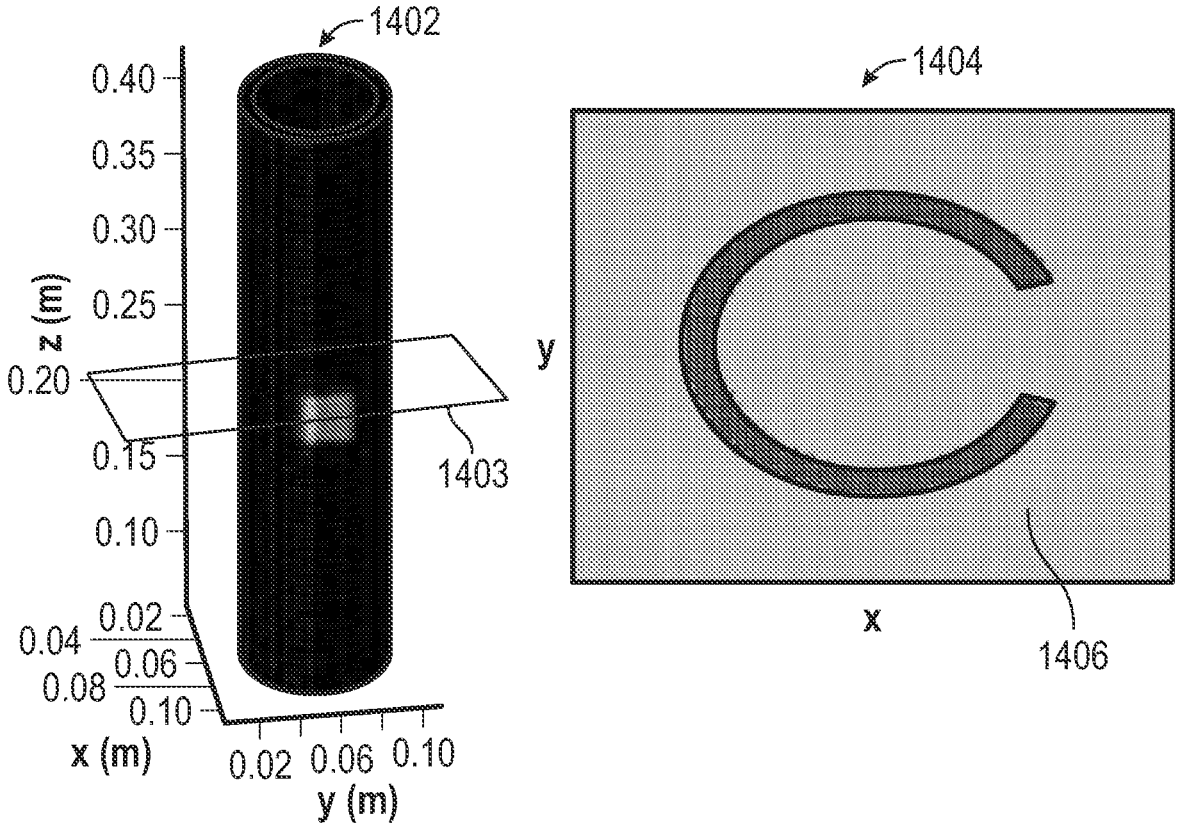
FIG. 14 depicts a computational simulation, in accordance with one or more embodiments.

In accordance with one or more embodiments, the Maxwell equations are discretized and solved using a quasi-static finite difference time domain (QS-FDTD) forward model operating on a simulated pipe. FIG. 14 depicts the simulation domain of a simulated pipe. The simulated model (1402) depicts a 3-dimensional simulated pipe that has been discretized into cells. In the example simulated model (1402) shown in FIG. 14, a black cell indicates that the cell contains pipe material (i.e., metal) and a gray cell indicates that the cell is empty. In this case, empty cells correspond to regions on the simulated pipe where the simulated pipe is not present or completely eroded. FIG. 14 depicts the location of a 2D slice (1403) in the simulated pipe. A top-down view of the 2D slice (1404) is also provided in FIG. 14. The discretized grid (1406) defining the cells of the simulation domain can be seen in the top-down view of the 2D slice (1404). Using the QS-FDTD forward model, a plurality of receiver measurements can be simulated as if an EM inspection tool (402) was present in the simulated pipe. The plurality of simulated receiver measurements can be paired with the 2D slice (1403) of the simulated model (1402), which is retained as the desired target. Thus, the QS-FDTD forward model can form an input and target pair for any simulated pipe. The training dataset is a collection of input and target pairs formed over a variety of simulated pipes. To promote robustness and generalization capabilities in the one or more machine-learned models, the simulated pipes contain one or more defects with varying extents and locations (i.e., radial location, inner diameter, outer diameter, etc.). Further, the simulated model (1402) can contain two or more concentric pipes where each pipe may have one or more defects.

In one or more embodiments, the training dataset is augmented by rotating each simulation model around the longitudinal axis of the simulated pipe tool in increments of one degree to create 359 additional variations. In one or more embodiments, experimental data is obtained and included in the training dataset.

In accordance with one or more embodiments, the training dataset is duplicated such that there is a duplicate of the training dataset for each of the one or more composite machine-learned models. In one or more embodiments, noise is added to each duplicate of the training dataset. In one or more embodiments, the added noise follows a zero-mean Gaussian distribution with a given variance (i.e., noise~$N(0,\sigma^2)$). The variance, $\sigma^2$, of the zero-mean Gaussian noise is different for each duplicate of the training dataset. For example, consider the case where two composite machine-learned models are used. In this case, two duplicates of the training dataset are formed. A first composite machine-learned model (of the two composite machine-learned models) is trained using a first duplicate (of the two duplicates) of the training dataset, where zero-mean Gaussian noise of a first variance is added to the first duplicate. And, a second composite machine-learned model is trained using a second duplicate of the training dataset, where zero-mean Gaussian noise of a second variance is added to the second duplicate. In this way, each of the one or more composite machine-learned models is trained using a unique alteration of the training dataset produced with the QS-FDTD forward model. Note that the above description allows for the case where the variance is zero such that no noise is added to the training dataset.

In general, the one or more composite machine-learned models will need to be re-trained if the structure of the input is changed. For example, changes in the number of near- and far-field plates or receivers (602) in the EM inspection tool (402), a change in the stack distance (524), or a change to the number of layers considered in a plurality of receiver measurements would all require a re-training of the one or more composite machine-learned models. However, it is noted that training the models is relatively cheap, in terms of computation cost, when compared to running the QS-FDTD forward model. In practice the data generated by the QS-FDTD forward model does not need to be re-generated as, once acquired, it can be used to form the receiver values for any desired input structure.

Figure 15:
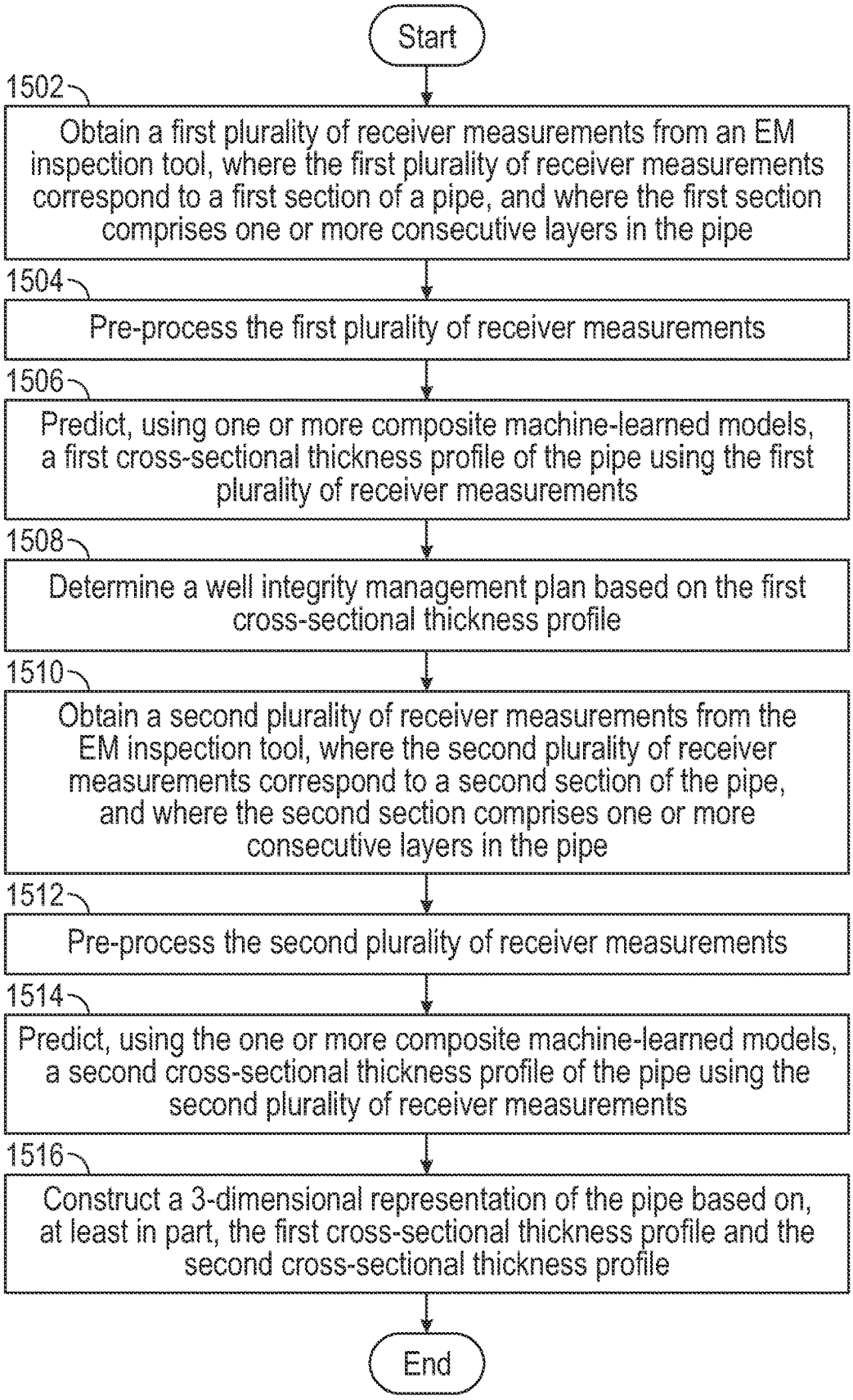
FIG. 15 depicts a flowchart, in accordance with one or more embodiments.

In accordance with one or more embodiments, FIG. 15 depicts a flowchart outlining the process of transforming measurements recorded by the EM inspection tool (402) in a pipe (410) to cross-sectional thickness profiles of the pipe (410). It is noted that pipe (410) may include more than one nested pipes. In Block 1502, a first plurality of receiver measurements is obtained from the EM inspection tool (402). The first plurality of receiver measurements is acquired at one or more consecutive layers in the pipe (i.e., W layers). For clarity, the one or more consecutive layers at which the first plurality of receiver measurements is collected are referred to as a first section in the pipe. In Block 1504, the first plurality of receiver measurements is pre-processed. Pre-processing may include standardizing each combination receiver value in the first plurality of receiver measurements using a plurality of reference receiver measurements. In general, reference receiver measurements are combination receiver values acquired at a portion of the pipe (410) where the pipe (410) is in pristine condition (i.e., full thickness, no defects). Pre-processing may also include duplicating and reshaping the first plurality of receiver measurements for use by one or more composite machine-learned models. In Block 1506, the first plurality of receiver measurements, after pre-processing if applicable, are processed by the one or more composite machine learned models to predict a first cross-sectional thickness profile of the pipe. Note that, in general, the predicted cross-sectional profile is an aggregation of the results of each of the one or more composite machine-learned models. The predicted first cross-sectional thickness profile indicates the number, location, and extent of defects (i.e., corrosion, metal loss) in the surrounding pipe (410) at a location in the first section. In Block 1508, a well integrity management plan is determined based on the first cross-sectional thickness profile. The well integrity management plan is tailored according to the observed defects, if any, in the first section. The well integrity management plan may include identifying maintenance and repair strategies and/or adjusting well operational and production settings to maximize hydrocarbon production. In Block 1510, a second plurality of receiver measurements is obtained from the EM inspection tool (402). The second plurality of receiver measurements correspond to a second section of the pipe (410), where the second section includes one or more consecutive layers in the pipe (410). In Block 1512, the second plurality of receiver measurements is pre-processed. In Block 1514, using the one or more composite machine-learned models applied to the second plurality of receiver measurements, a second cross-sectional thickness profile is predicted. The second cross-sectional thickness profile identifies defects, and their structure, in the second section of the pipe (410). In Block 1516, a 3-dimensional representation of the pipe (410) is constructed. The 3-dimensional representation is based on, at least in part, the first cross-sectional thickness profile and the second cross-sectional thickness profile. That is, the first and second cross-sectional thickness profiles may be stacked, or otherwise stitched, according to their depth and orientation relative to the central longitudinal axis (504) of the EM inspection tool (402), to form the 3-dimensional representation of the pipe (410). While the flowchart of FIG. 15 provides for predicting a first and second cross-sectional thickness profiles at a first and second section of the pipe (410), the processes of FIG. 15 can be applied to any number of sections in the pipe (410) and a 3-dimensional representation of the pipe (410) can be formed for the entire length of the pipe (410) (i.e., for all layers).

Figure 16:
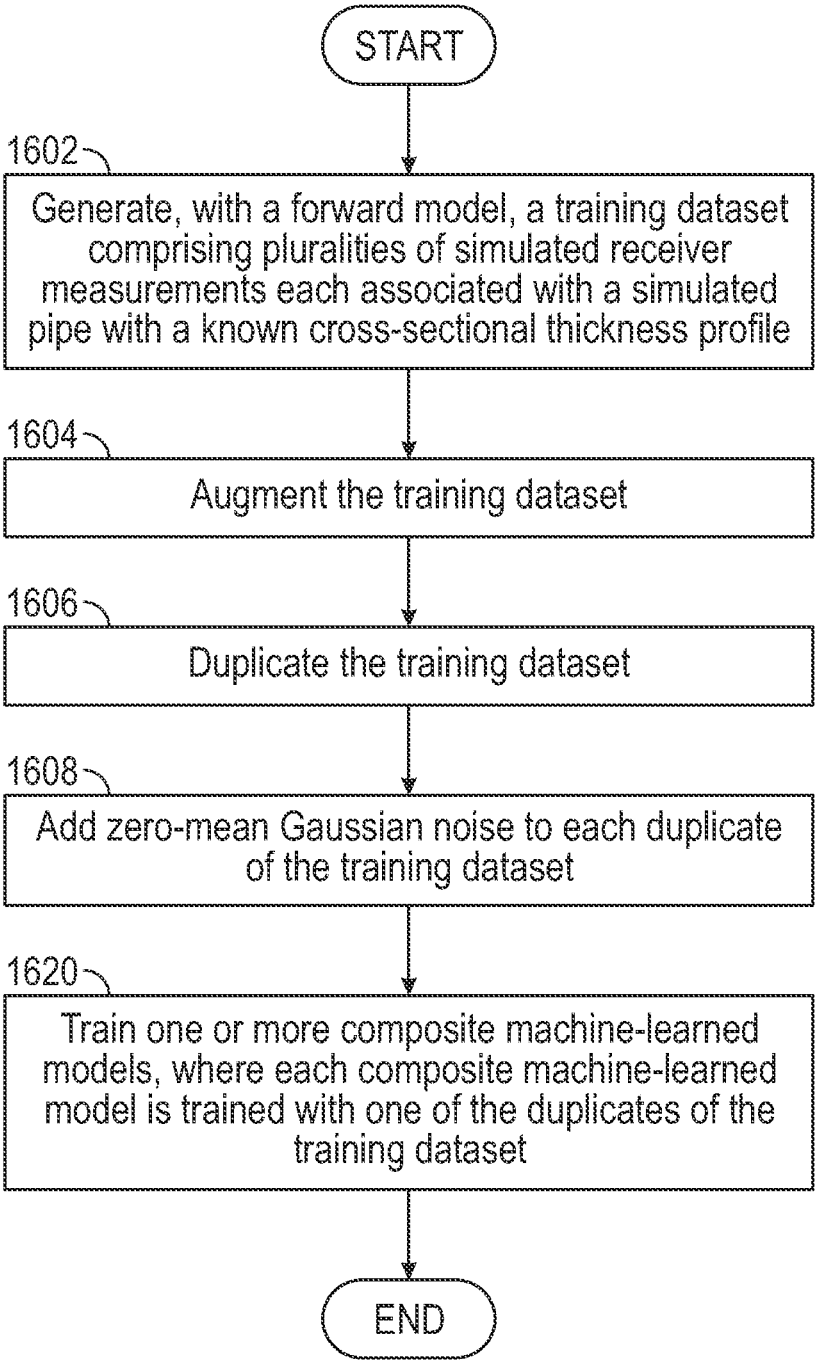
FIG. 16 depicts a flowchart, in accordance with one or more embodiments.

In accordance with one or more embodiments, FIG. 16 depicts a flowchart outlining the process of generating a training dataset and training the one or more composite machine-learned models. In Block 1602, a forward model (e.g., QS-FDTD model) is used to simulate pluralities of simulated receiver measurements. Each plurality of simulated receiver measurements is obtained by applying the forward model to a simulated pipe with a known cross-sectional thickness profile. Various simulated pipes, each with unique defects, are modeled. In Block 1604, the training dataset is augmented. In one or more embodiments, the augmentation includes rotations of the simulated pipe relative to a simulated EM inspection tool (402) (or at least the locations of simulated receivers). In one or more embodiments, the training dataset is augmented with experimentally obtained data. In Block 1606, the training dataset is duplicated. The training dataset is duplicated such that there is one duplicate of the training dataset for each of the one or more machine-learned models. In Block 1608, a zero-mean Gaussian noise distribution with a given variance is added to each duplicate of the training dataset. The variance of the zero-mean Gaussian noise distribution is different for each of the duplicates of the training dataset. In one or more embodiments, the variance of the zero-mean Gaussian noise distribution added to one of the duplicate training datasets is zero. In Block 1620, the one or more composite machine-learned models are trained. Each of the one or more composite machine-learned models is trained using one of the duplicates of the training dataset. That is, there is one duplicate of the training dataset for each of the one or more composite machine-learned models.

While multiple embodiments of the EM inspection tool (402), the one or more composite machine-learned models, and the method of generation training data have been described herein, one with ordinary skill in the art that multiple variations of these elements exist and can be applied without departing from the scope of this disclosure. For example, in one or more embodiments, the LSTM layers may be improved by adding densely connected neural networks before each LSTM layer. The added densely connected neural networks can extract feature relationships between receivers (602) and improve the overall performance of the composite machine-learned model. Further, LSTM layers may be replaced by 1-dimensional CNNs. In one or more embodiments, the data generated by the forward model may be split into a training dataset, validation dataset, and a test dataset. The validation dataset may be used to guide the training of the one or more composite machine learned-models and indicate desired changes in the hyper-parameters or architecture of the composite machine-learned model.

Embodiments of the present disclosure may provide at least one of the following advantages. The predicted cross-sectional thickness profiles detail the number, location, and extent of defects on a pipe (410). The ability to image the cross-section of the surrounding pipe (410) with an EM inspection tool (402) is a significant improvement over the state-of-the-art methods that can only determine the total circumferential or average circumferential thickness of the pipe (410). The predicted cross-sectional thickness profiles remove ambiguity as to the location, extent, and type of defect present in the pipe (410). A further advantage of the EM inspection tool (402), methods, and models described herein is that the connectivity of defects across layers can be determined using the 3-dimensional representation of a pipe (410). Evaluation of how defects are connected yields information regarding how one or more defects may have formed. Finally, embodiments disclosed herein allow for the creation of well integrity management strategies that are tailored to the nature of the defects.

Figure 17:
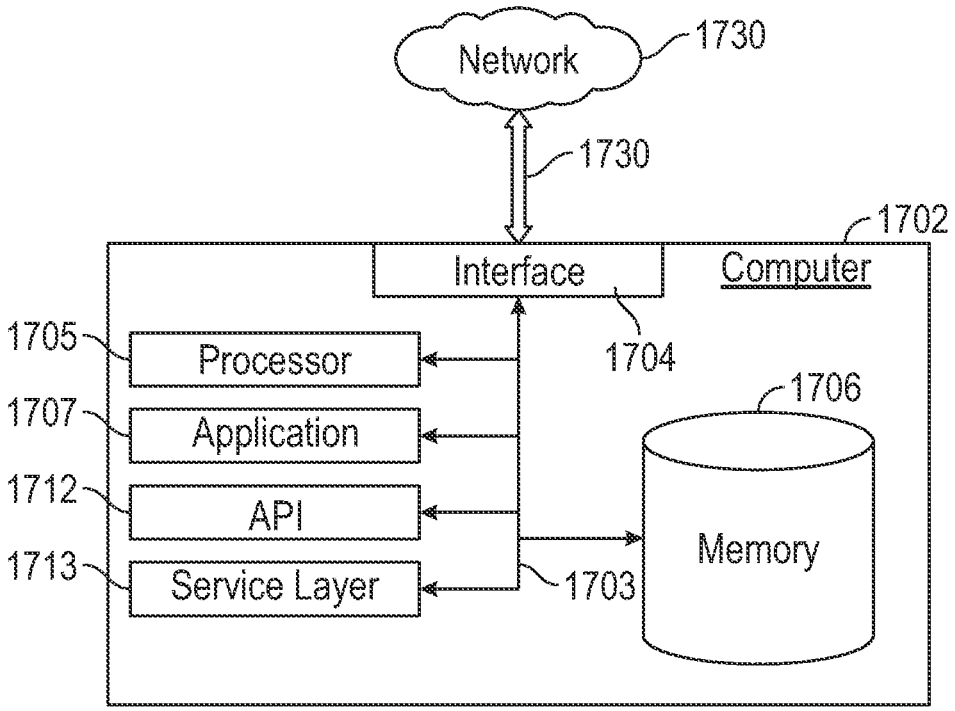
FIG. 17 depicts a system, in accordance with one or more embodiments.

FIG. 17 further depicts a block diagram of a computer system (1702) used to provide computational functionalities associated with the algorithms, methods, functions, processes, flows, and procedures as described in this disclosure, according to one or more embodiments. The illustrated computer (1702) is intended to encompass any computing device such as a server, desktop computer, laptop/notebook computer, wireless data port, smart phone, personal data assistant (PDA), tablet computing device, one or more processors within these devices, or any other suitable processing device, including both physical or virtual instances (or both) of the computing device. Additionally, the computer (1702) may include a computer that includes an input device, such as a keypad, keyboard, touch screen, or other device that can accept user information, and an output device that conveys information associated with the operation of the computer (1702), including digital data, visual, or audio information (or a combination of information), or a GUI.

The computer (1702) can serve in a role as a client, network component, a server, a database or other persistency, or any other component (or a combination of roles) of a computer system for performing the subject matter described in the instant disclosure. In some implementations, one or more components of the computer (1702) may be configured to operate within environments, including cloud-computing-based, local, global, or other environment (or a combination of environments).

At a high level, the computer (1702) is an electronic computing device operable to receive, transmit, process, store, or manage data and information associated with the described subject matter. According to some implementations, the computer (1702) may also include or be communicably coupled with an application server, e-mail server, web server, caching server, streaming data server, business intelligence (BI) server, or other server (or a combination of servers).

The computer (1702) can receive requests over network (1730) from a client application (for example, executing on another computer (1702) and responding to the received requests by processing the said requests in an appropriate software application. In addition, requests may also be sent to the computer (1702) from internal users (for example, from a command console or by other appropriate access method), external or third-parties, other automated applications, as well as any other appropriate entities, individuals, systems, or computers.

Each of the components of the computer (1702) can communicate using a system bus (1703). In some implementations, any or all of the components of the computer (1702), both hardware or software (or a combination of hardware and software), may interface with each other or the interface (1704) (or a combination of both) over the system bus (1703) using an application programming interface (API) (1712) or a service layer (1713) (or a combination of the API (1712) and service layer (1713). The API (1712) may include specifications for routines, data structures, and object classes. The API (1712) may be either computer-language independent or dependent and refer to a complete interface, a single function, or even a set of APIs. The service layer (1713) provides software services to the computer (1702) or other components (whether or not illustrated) that are communicably coupled to the computer (1702). The functionality of the computer (1702) may be accessible for all service consumers using this service layer. Software services, such as those provided by the service layer (1713), provide reusable, defined business functionalities through a defined interface. For example, the interface may be software written in JAVA, C++, or other suitable language providing data in extensible markup language (XML) format or another suitable format. While illustrated as an integrated component of the computer (1702), alternative implementations may illustrate the API (1712) or the service layer (1713) as stand-alone components in relation to other components of the computer (1702) or other components (whether or not illustrated) that are communicably coupled to the computer (1702). Moreover, any or all parts of the API (1712) or the service layer (1713) may be implemented as child or sub-modules of another software module, enterprise application, or hardware module without departing from the scope of this disclosure.

The computer (1702) includes an interface (1704). Although illustrated as a single interface (1704) in FIG. 17, two or more interfaces (1704) may be used according to particular needs, desires, or particular implementations of the computer (1702). The interface (1704) is used by the computer (1702) for communicating with other systems in a distributed environment that are connected to the network (1730). Generally, the interface (1704) includes logic encoded in software or hardware (or a combination of software and hardware) and operable to communicate with the network (1730). More specifically, the interface (1704) may include software supporting one or more communication protocols associated with communications such that the network (1730) or interface's hardware is operable to communicate physical signals within and outside of the illustrated computer (1702).

The computer (1702) includes at least one computer processor (1705). Although illustrated as a single computer processor (1705) in FIG. 17, two or more processors may be used according to particular needs, desires, or particular implementations of the computer (1702). Generally, the computer processor (1705) executes instructions and manipulates data to perform the operations of the computer (1702) and any algorithms, methods, functions, processes, flows, and procedures as described in the instant disclosure.

The computer (1702) also includes a memory (1706) that holds data for the computer (1702) or other components (or a combination of both) that can be connected to the network (1730). The memory may be a non-transitory computer readable medium. For example, memory (1706) can be a database storing data consistent with this disclosure. Although illustrated as a single memory (1706) in FIG. 17, two or more memories may be used according to particular needs, desires, or particular implementations of the computer (1702) and the described functionality. While memory (1706) is illustrated as an integral component of the computer (1702), in alternative implementations, memory (1706) can be external to the computer (1702).

The application (1707) is an algorithmic software engine providing functionality according to particular needs, desires, or particular implementations of the computer (1702), particularly with respect to functionality described in this disclosure. For example, application (1707) can serve as one or more components, modules, applications, etc. Further, although illustrated as a single application (1707), the application (1707) may be implemented as multiple applications (1707) on the computer (1702). In addition, although illustrated as integral to the computer (1702), in alternative implementations, the application (1707) can be external to the computer (1702).

There may be any number of computers (1702) associated with, or external to, a computer system containing computer (1702), wherein each computer (1702) communicates over network (1730). Further, the term "client," "user," and other appropriate terminology may be used interchangeably as appropriate without departing from the scope of this disclosure. Moreover, this disclosure contemplates that many users may use one computer (1702), or that one user may use multiple computers (1702).

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims.

What is claimed is:

1. An electromagnetic (EM) inspection tool for inspecting a pipe, comprising:

a longitudinally extending body having a first end, a second end, and a central longitudinal axis;

a transmitter disposed proximate the first end and configured to generate an alternating EM field at a first frequency;

a first far-field receiver plate disposed proximate the second end, wherein the first far-field receiver plate comprises a first far-field receiver disposed at a first radial location and a second far-field receiver disposed at a second radial location;

a second far-field receiver plate disposed adjacent to the first far-field receiver plate, wherein the second far-field receiver plate comprises a third far-field receiver disposed at a third radial location and a fourth far-field receiver disposed at a fourth radial location;

a first near-field receiver plate disposed circumferentially around the transmitter, wherein the first near-field receiver plate comprises a first near-field receiver disposed at the first radial location and a second near-field receiver disposed at the second radial location; and a second near-field receiver plate disposed adjacent to the first near-field receiver plate, wherein the second near-field receiver plate comprises a third near-field receiver disposed at the third radial location and a fourth near-field receiver disposed at the fourth radial location.

2. The EM inspection tool of claim 1, wherein the first far-field receiver plate further comprises a fifth far-field receiver disposed at a fifth radial location and wherein the first near-field receiver plate further comprises a fifth near-field receiver disposed at the fifth radial location.

3. The EM inspection tool of claim 1, wherein the first far-field receiver plate is located a stack distance along the central longitudinal axis from the transmitter, wherein the stack distance is determined according to an inner diameter of the pipe.

4. The EM inspection tool of claim 1, wherein the third radial location is angularly offset from the first radial location according to an offset angle, wherein the offset angle is determined according to a total number of near-field plates.

5. The EM inspection tool of claim 3, wherein the stack distance is 1.5 to 3.5 times the inner diameter.

6. A method for inspecting a pipe, comprising:

deploying an electromagnetic (EM) inspection tool to a first section in the pipe wherein the first section comprises a first layer and the EM inspection tool comprises:

a longitudinally extending body having a first end, a second end, and a central longitudinal axis, a transmitter disposed proximate the first end and configured to generate an alternating EM field at a first frequency, a first far-field receiver plate disposed proximate the second end, wherein the first far-field receiver plate comprises a first far-field receiver disposed at a first radial location and a second far-field receiver disposed at a second radial location, and a first near-field receiver plate disposed circumferentially around the transmitter, wherein the first near-field receiver plate comprises a first near-field receiver disposed at the first radial location and a second near-field receiver disposed at the second radial location;

obtaining a first plurality of receiver measurements from the EM inspection tool at the first section;

pre-processing the first plurality of receiver measurements, comprising:

subtracting the first plurality of receiver measurements from a plurality of reference receiver measurements, wherein the plurality of reference receiver measurements is obtained at a section in the pipe where the pipe is known to be at a full thickness duplicating the first plurality of receiver measurements to form a first copy and a second copy, and reshaping the first copy and the second copy; and predicting, using a composite machine-learned model, a first cross-sectional thickness profile of the pipe using the first copy and the second copy.

7. The method of claim 6, further comprising:

determining a well integrity management plan based on, at least, the first cross-sectional thickness profile.

8. The method of claim 6, wherein the first section further comprises a second layer and wherein the first layer and the second layer are adjacent.

9. The method of claim 8, further comprising:

deploying an electromagnetic (EM) inspection tool to a second section in the pipe wherein the second section comprises a third layer;

obtaining a second plurality of receiver measurements from the EM inspection tool at the second section; and predicting, using the composite machine-learned model, a second cross-sectional thickness profile of the pipe using the second plurality of receiver measurements.

10. The method of claim 9, wherein the second section further comprises a fourth layer and wherein the third layer and the fourth layer are adjacent.

11. The method of claim 9, wherein the second layer and the third layer are the same layer.

12. The method of claim 6, further comprising:

predicting, using the composite machine-learned model and another composite machine-learned model, first cross-sectional thickness profile of the pipe using the first plurality of receiver measurements, wherein the first cross-sectional thickness profile is predicted by aggregating results from the composite machine-learned model and the another machine-learned model.

13. The method of claim 9, further comprising:

constructing a three-dimensional representation of the pipe based on, at least in part, the first cross-sectional thickness profile and the second cross-sectional thickness profile.

* * * * *